US007538736B2

(12) United States Patent
Kanno et al.

(10) Patent No.: US 7,538,736 B2
(45) **Date of Patent: *May 26, 2009**

(54) VARIABLE SLOT ANTENNA AND DRIVING METHOD THEREOF

(75) Inventors: Hiroshi Kanno, Osaka (JP); Tomoyasu Fujishima, Kanagawa (JP)

(73) Assignee: Panasonic Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/179,059

(22) Filed: Jul. 24, 2008

(65) Prior Publication Data

US 2008/0272972 A1 Nov. 6, 2008

Related U.S. Application Data

(63) Continuation of application No. PCT/JP2007/060550, filed on May 23, 2007.

(30) Foreign Application Priority Data

May 25, 2006 (JP) ..... 2006-144799

(51) Int. Cl.
*H01Q 13/10* (2006.01)

(52) U.S. Cl. ..... 343/767; 343/768; 343/770

(58) Field of Classification Search ..... 343/767, 343/770, 700 MS, 768, 876, 846
See application file for complete search history.

(56) References Cited

U.S. PATENT DOCUMENTS 5,268,696 A 12/1993 Buck et al.

(Continued)

FOREIGN PATENT DOCUMENTS

EP 1 158 605 A1 11/2001

(Continued)

OTHER PUBLICATIONS

Lei Zhu, "A Novel Broadband Microstrip-Fed Wide Slot Antenna With Double Rejection Zeros", IEEE Antennas and Wireless Propagation Letters, 2003, pp. 194-196, vol. 2, IEEE.

(Continued)

*Primary Examiner*—Tho G Phan
(74) *Attorney, Agent, or Firm*—McDermott Will & Emery LLP

(57) ABSTRACT

A variable slot antenna includes: ground conductors 101*a* and 101*b*, which are divided by a slot region 109 both of whose both ends are open ends 111*a* and 111*b*; a feed line 115 for feeding power to the slot region 109; a first selective conduction path 119 connecting between the ground conductors 101*a* and 101*b* in a direction of the open end 111*a* as viewed from a feeding site 113; and a second selective conduction path 121 connecting between the ground conductors 101*a* and 101*b* in a direction of the open end 111*b* as viewed from the feeding site 113. In a first driving state, the first selective conduction path 119 is allowed to conduct and the second selective conduction path 121 is left open, so that a main beam is emitted in a direction 123*a* of the second selective conduction path 121 as viewed from the feeding site 113. In another driving state, the selective conduction paths are controlled differently so that the main beam direction is switched to a direction 123*b*.

20 Claims, 19 Drawing Sheets

U.S. PATENT DOCUMENTS

| | | | | |
|---|---|---|---|---|
| 5,442,367 | A | 8/1995 | Naito et al. | |
| 5,539,420 | A | 7/1996 | Dusseux et al. | |
| 6,150,989 | A | 11/2000 | Aubry | |
| 6,188,368 | B1 * | 2/2001 | Koriyama et al. | 343/767 |
| 6,292,153 | B1 | 9/2001 | Aiello et al. | |
| 6,366,254 | B1 | 4/2002 | Sievenpiper | |
| 6,664,931 | B1 * | 12/2003 | Nguyen et al. | 343/767 |
| 6,864,848 | B2 | 3/2005 | Sievenpiper | |
| 7,154,441 | B2 * | 12/2006 | Hansen et al. | 343/700 MS |
| 2003/0020664 | A1 | 1/2003 | Thudor et al. | |
| 2003/0122721 | A1 | 7/2003 | Sievenpiper | |
| 2003/0222824 | A1 | 12/2003 | Louzir et al. | |
| 2005/0162327 | A1 | 7/2005 | Mori | |
| 2005/0162328 | A1 | 7/2005 | Mori | |
| 2005/0200530 | A1 | 9/2005 | Aikawa et al. | |
| 2006/0044200 | A1 | 3/2006 | Mori | |
| 2007/0080881 | A1 | 4/2007 | Thudor et al. | |

FOREIGN PATENT DOCUMENTS

| | | |
|---|---|---|
| JP | 31-464 | 1/1956 |
| JP | 3-65681 | 3/1991 |
| JP | 3224323 | 10/1991 |
| JP | 5-14034 | 1/1993 |
| JP | 06-085520 | 3/1994 |
| JP | 2654248 | 9/1997 |
| JP | 10-256826 | 9/1998 |
| JP | 11-46115 | 2/1999 |
| JP | 2882928 | 2/1999 |
| JP | 2951707 | 7/1999 |
| JP | 2002-084130 | 3/2002 |
| JP | 3360118 | 10/2002 |
| JP | 2003-101337 | 4/2003 |
| JP | 2003-527018 | 9/2003 |
| JP | 2004-007705 | 1/2004 |
| JP | 2004-129234 | 4/2004 |
| JP | 2004-304226 | 10/2004 |
| JP | 2004-304705 | 10/2004 |
| JP | 2005-079972 | 3/2005 |
| JP | 2005-514844 | 5/2005 |
| JP | 2005-210520 | 8/2005 |
| JP | 2005-210521 | 8/2005 |
| JP | 2005-217667 | 8/2005 |
| JP | 2006-005679 | 1/2006 |
| JP | 2006-066993 | 3/2006 |
| JP | 2006-310927 | 11/2006 |
| WO | WO 2005/081360 A1 | 1/2005 |
| WO | WO 2005/013419 A1 | 2/2005 |
| WO | WO/2005-125034 | 12/2005 |

OTHER PUBLICATIONS

Co-pending U.S. Continuation of Application under 111a entitled "Variable Slot Antenna and Driving Method Thereof", filed on Jul. 24, 2008.

Japanese Office Action, with English Translation, issued in Japanese Application No. JP 2007-554778 dated on Mar. 18, 2008.

* cited by examiner

VARIABLE SLOT ANTENNA AND DRIVING METHOD THEREOF

This is a continuation of International Application No. PCT/JP2007/060550, with an international filing date of May 23, 2007, which claims priority of Japanese Patent Application No. 2006-144799, filed on May 25, 2006, the contents of which are hereby incorporated by reference.

BACKGROUND OF THE INVENTION

1. Field of the Invention

The present invention relates to: an antenna with which a digital signal or an analog high-frequency signal, e.g., that of a microwave range or an extremely high frequency range, is transmitted or received; and a driving method thereof.

2. Description of the Related Art

Various techniques have been proposed over the years for changing the directivity of an antenna and subjecting an emitted beam for scanning. For example, some methods, e.g., adaptive arrays, allow a signal which is received via a plurality of antennas to be processed in a digital signal section to equivalently realize a beam scanning. Other methods, e.g., sector antennas, place a plurality of antennas in different orientations in advance, and switch the main beam direction through switching of a path on the feed line side. There are also methods which place reflectors and directors (which are unfed elements) near an antenna to tilt the main beam direction.

The slot antenna is one of the most basic resonant antennas, and is a promising antenna in terms of applications to wideband communications because it is expected to provide bandwidth ratio characteristics of about 10% in the case where the slot length corresponds to a ½ effective wavelength and at least 15% or more in the case where the slot length corresponds to a ¼ effective wavelength. These values are wideband as compared to a bandwidth ratio of about 5% of a patch antenna, which is a similarly basic resonant antenna.

Japanese Laid-Open Patent Publication No. 2003-527018 (hereinafter "Patent Document 1") discloses, as a sector antenna utilizing a slot antenna, a sector antenna structure in which a plurality of slot antennas are radially placed to realize switching of the main beam direction through switching of a path on the feed line side. In Patent Document 1, a Vivaldi antenna which is known to have ultrawideband antenna characteristics is used as an antenna to realize global switching of the main beam direction of emitted electromagnetic waves having ultrawideband frequency components.

Moreover, Japanese Laid-Open Patent Publication No. 2005-210520 (hereinafter "Patent Document 2") discloses an example of a variable antenna which employs unfed parasitic elements for tilting a main beam direction in which emission from a radiation slot element occurs. In the variable antenna shown in FIG. 20, in proximity, a ½ effective wavelength slot resonator which is excited by a feed line 115 as a radiator 201 and unfed slot resonators serving as parasitic elements 203*a* and 203*b* are placed on a ground conductor 101. Through adjustment of the slot lengths of the parasitic elements 203*a* and 203*b*, switching can be made as to whether the parasitic elements function as directors or reflectors relative to a reflector, thus varying the direction of an emitted beam from the radiator. In order to allow the parasitic elements 203*a* and 203*b* to function as directors, the slot lengths of the parasitic elements may be adjusted to be shorter than the slot length of the radiator. In order to allow the parasitic elements 203*a* and 203*b* to function as reflectors, the slot lengths of the parasitic elements may be adjusted to be longer than the slot length of the radiator. In order to adjust a slot length, a slot length which is longer than necessary is prescribed on the circuit board; and, in a state of allowing the element to function as a slot circuit with a short slot length, somewhere along the slot length, selectively conduction is achieved by means of a switching element 205*a* or 205*b* so as to astride the slot along the width direction between portions of ground conductor. Patent Document 2 mentions use of MEMS switches as an exemplary method of implementing the switching elements 205*a* and 205*b*.

An antenna for a mobile terminal device for fast communications not only needs to be downsized, but also needs to be able to vary the main beam direction of electromagnetic waves emitted therefrom, in order to avoid interference waves such as reflected waves. However, conventional slot antennas have the following problems.

Firstly, in the antenna disclosed in Patent Document 1, four slot antennas, most of whose constituent elements are not shared, are radially placed within the structure, and a driving method is used which switches the feed circuit for each slot antenna, whereby a function of switching the main beam direction is realized. However, there is a problem in that the antenna structure is large.

Secondly, in the antenna disclosed in Patent Document 2, too, slot antennas whose constituent elements are not shared are placed in parallel, thus presenting a problem from the standpoint of downsizing. Moreover, there is only a limited frequency band in which the slot antennas to be used as parasitic elements function as directors or reflectors, thus resulting in a problem in that the main beam direction of the antenna may possibly change to a different direction within the operating frequency band. Thus, the antenna disclosed in Patent Document 2 may be applicable to a narrow-band communication system, but is difficult to be applied to a communication system where a wide frequency band is required for performing high-speed transmission. To be more specific, firstly, the ½ effective wavelength slot resonator has a radiation band of about 10%, which makes it necessary to adjust the slot length of each parasitic element so as to operate at a frequency which is different by 5% or more from the center frequency of the operating band. Secondly, it is necessary to maintain a degree of coupling between the radiator and the parasitic elements at an upper limit frequency and a lower limit frequency of the operating band. However, coupling between the slot resonators tends to lower as the difference between their resonant frequencies increases, and therefore it is difficult to simultaneously satisfy the above two conditions. Moreover, the antenna disclosed in Patent Document 2 may be capable of tilting the main beam direction, but is not able to realize drastic switchability, e.g., invert the main beam direction.

SUMMARY OF THE INVENTION

The present invention solves the aforementioned conventional problems, and an objective thereof is to provide a driving method for a variable slot antenna which, while maintaining a small circuit structure and maintaining the same main beam direction across a relatively wide operating band, realizes a main beam direction switching function in a wide variable angle range.

According to the present invention, there is provided a driving method for a variable directivity slot antenna, the variable directivity slot antenna including:

a dielectric substrate; and a ground conductor and a slot region formed on a rear face of the dielectric substrate, the ground conductor having a finite area, wherein, the slot region divides the ground conductor into a first ground conductor and a second ground conductor;

both leading ends of the slot region are open ends;

at least two selective conduction paths are further provided on the rear face of the dielectric substrate, the at least two selective conduction paths traversing the slot region to connect the first ground conductor and the second ground conductor;

a feed line intersecting the slot region at a feeding site near a center of the slot region along a longitudinal direction thereof is provided on a front face of the dielectric substrate;

the at least two selective conduction paths include a first selective conduction path and a second selective conduction path;

a slot resonator length Ls is defined as a distance between the first selective conduction path and the open end of the slot region located at the leading end in an −X direction;

a slot width Ws is defined as a distance between the first ground conductor and the second ground conductor;

a distance between the second selective conduction path and the open end of the slot region located at the leading end in an X direction is equal to the slot resonator length Ls;

when Ws is equal to or less than (Ls/8), Ls is prescribed equal to a ¼ effective wavelength at a center frequency f0 of an operating band;

when Ws exceeds (Ls/8), (2Ls+Ws) is prescribed equal to a ½ effective wavelength at the center frequency f0 of the operating band;

in a see-through plan view in which the variable directivity slot antenna is seen through from a normal direction of the dielectric substrate, the feed line appears interposed between the first selective conduction path and the second selective conduction path;

the X direction is defined as the longitudinal direction of the slot region, a Y direction is defined as a longitudinal direction of the feed line, and a Z direction is defined as the normal direction of the dielectric substrate;

the first selective conduction path is disposed between the open end of the slot region located at the leading end in the X direction and the feeding site, and the second selective conduction path is disposed between the open end of the slot region located at the leading end in the −X direction and the feeding site;

the method comprising:

a first step of selecting the first selective conduction path to be in a conducting state and selecting the second selective conduction path to be in an open state, thus causing a main beam to be emitted in the −X direction; and a second step of selecting the first selective conduction path to be in an open state and selecting the second selective conduction path to be in a conducting state, thus causing a main beam to be emitted in the X direction.

According to the present invention, it is possible to simultaneously satisfy downsizing of the structure, consistency of the main beam direction within the operating band, and a function of switching the main beam direction across a wide range, which have been difficult to achieve in conventional variable slot antennas. A variable slot antenna according to the present invention can be utilized in a mobile terminal device which is in a constantly-changing transmission/reception situation.

Other features, elements, processes, steps, characteristics and advantages of the present invention will become more apparent from the following detailed description of preferred embodiments of the present invention with reference to the attached drawings.

BRIEF DESCRIPTION OF THE DRAWINGS

FIG. 1A illustrates a case where the main beam direction is oriented toward the right; and FIG. 1B illustrates a case where the main beam direction is oriented toward the left.

FIG. 2A is a cross-sectional structural diagram taken along line A1-A2 in FIG. 1A; and FIG. 2B is cross-sectional structural diagram taken along line B1-B2 in FIG. 1A.

FIG. 3A is a schematic diagram corresponding to the driving condition of FIG. 1A; and FIG. 3B is a schematic diagram corresponding to the driving condition of FIG. 1B.

FIG. 10A illustrates a traditional power-feeding structure; and FIG. 10B illustrates the case of obtaining a multiple resonance operation.

FIG. 16A is a radiation characteristics comparison diagram at 3 GHz, in first and second driving states; and FIG. 16B is a radiation characteristics comparison diagram at 4 GHz, in first and second driving states.

FIG. 19A is a radiation characteristics comparison diagram at 2.5 GHz, in first and second driving states; FIG. 19B is a radiation characteristics comparison diagram at 4.5 GHz, in first and second driving states.

DETAILED DESCRIPTION OF PREFERRED EMBODIMENTS

Hereinafter, embodiments of the present invention will be described with reference to the drawings.

Embodiments

Figure 1B:
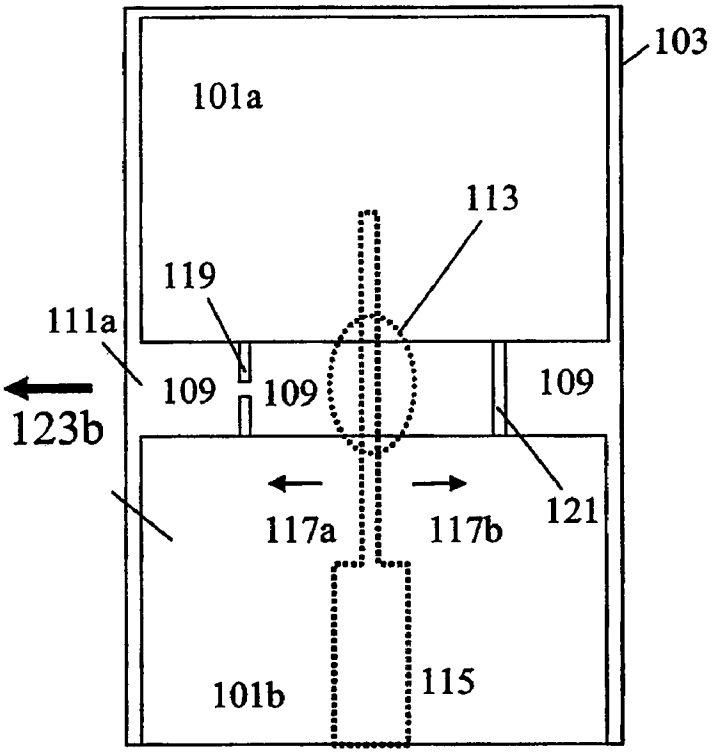
FIGS. 1A and 1B are lower schematic see-through views of a variable slot antenna to be driven by a driving method according to the present invention.
Figure 1A:
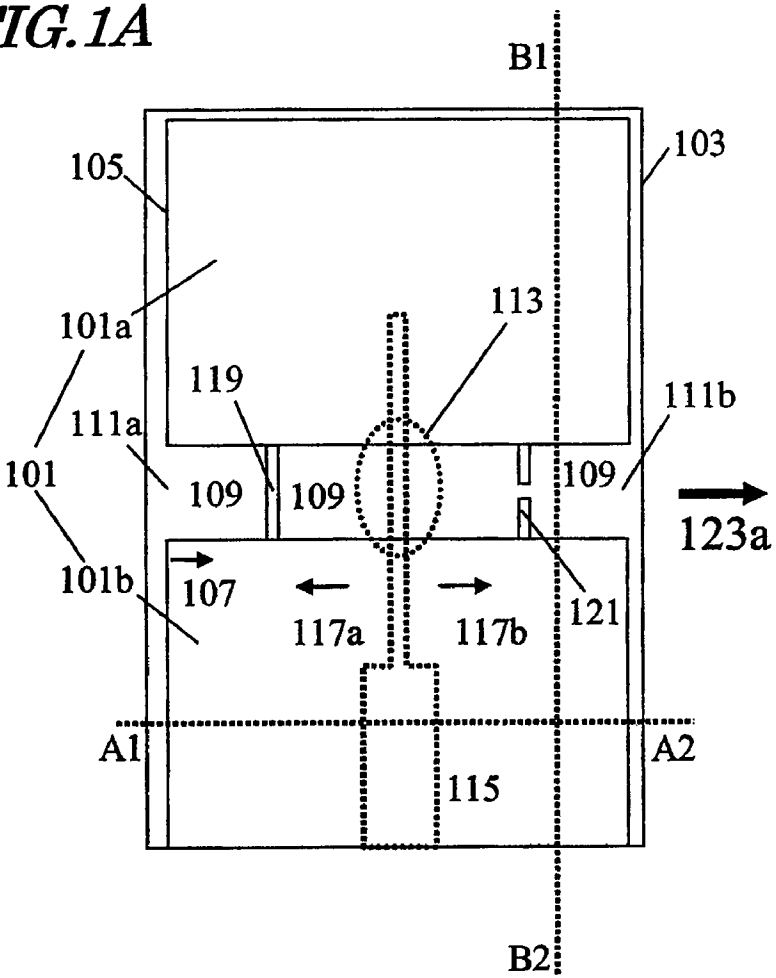
Figure 2A:
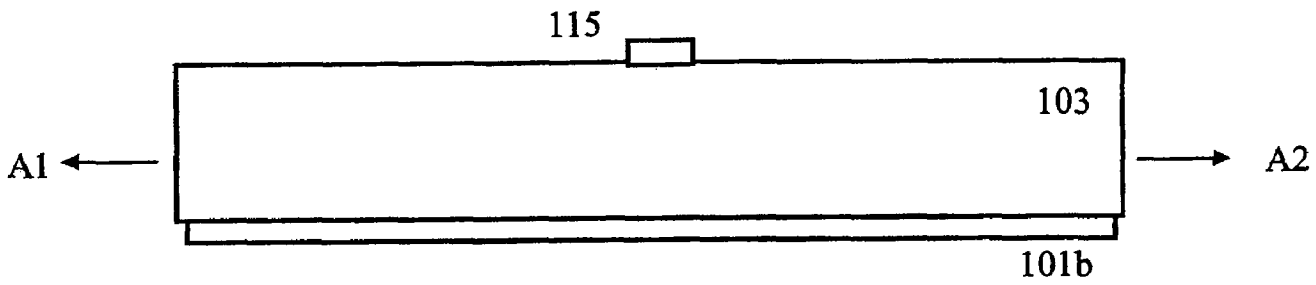
FIGS. 2A and 2B are cross-sectional structural diagrams of a variable slot antenna to be driven by the driving method according to the present invention.
Figure 2B:
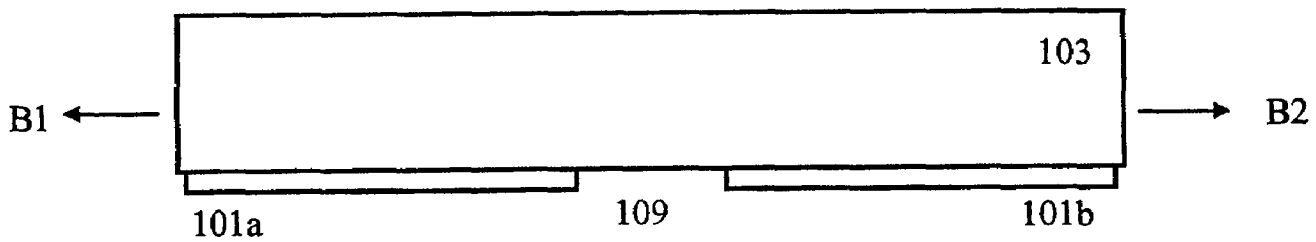

FIGS. 1A and 1B are lower schematic see-through views (see-through views as seen through the rear face) showing the structure of a variable slot antenna to be driven by a driving method according to the present embodiment, and schematically illustrate switchability as to directivity characteristics of the variable slot antenna obtained in two states of the present driving method. FIGS. 2A and 2B show schematic cross-sectional views of the structure taken along lines A1-A2 and B1-B2 in FIGS. 1A and 1B. For simplicity of discussion, a variable slot antenna structure which is symmetric between right and left will be illustrated as an example of a high-symmetry embodiment, and an embodiment of a driving method which involves switching the main beam direction toward the right or left will be described.

A ground conductor 101 having a finite area is formed on a rear face of a dielectric substrate 103, and a slot region 109 is formed which recesses into the ground conductor 101 in a depth direction 107 from a side outer edge 105, both ends of the slot region 109 being left open. In other words, the finite ground conductor 101 is split by the slot region 109 into two: a first ground conductor 101*a* and a second ground conductor 101*b*. As a result, both ends of the slot region 109 become a first open end 111*a* and a second open end 111*b*. At a feeding site 113 in the center of the slot region 109, the slot region 109 intersects a feed line 115 which is formed on the front face (upper face) of the dielectric substrate 103. When the direction of the first open end 111*a* as viewed from the feeding site 113 is defined as a first direction 117*a*, at least one first selective conduction path 119 is formed in the first direction 117*a* from the feeding site 113. Similarly, when the direction of the second open end 111*b* as viewed from the feeding site 113 is defined as a second direction 117*b*, at least one second selective conduction path 121 is formed in the second direction 117*b* from the feeding site 113. For simplicity of discussion, a case will be first described where there is one first selective conduction path 119 and one second selective conduction path 121. In other words, as shown in FIGS. 1A and 1B, the selective conduction paths 119 and 121 are disposed on the left side and the right side of the feeding site 113, one each. Based on an externally-supplied control signal, the first selective conduction path 119 and the second selective conduction path 121 may each permit selective conduction between the first ground conductor 101*a* and the second ground conductor 101*b*, which are split apart by the slot region 109. FIG. 1A illustrates a state where the first selective conduction path 119 is controlled to be conducting and the second selective conduction path 121 to be open. Conversely, FIG. 1B illustrates a state where the first selective conduction path 119 is controlled to be open and the second selective conduction path 121 to be conducting. Through such control of the first and second selective conduction paths 119 and 121, it becomes possible to direct the main beam of emitted electromagnetic waves in the direction of an arrow 123*a* in the state of FIG. 1A or in the direction of an arrow 123*b* in the state of FIG. 1B.

(Features of the Driving Method)

A driving method for a variable slot antenna according to an embodiment of the present invention is characterized in that either one of the first selective conduction path 119 and the second selective conduction path 121 is allowed to conduct, while the other selective conduction path is always selected to be open, whereby the main beam can be oriented in the direction of the open selective conduction path as viewed from the feeding site 113. Thus, by switching the selective conduction path to conduct and the selective conduction path to be open, it becomes possible to switch the main beam direction into different directions. For example, in order to direct the main beam in the right direction 123*a* (FIG. 1A), the second selective conduction path 121 placed on the right side of the feeding site 113 may be opened and the first selective conduction path 119 placed on the opposite side, i.e., left side, of the feeding site 113 may be short-circuited. Conversely, in order to direct the main beam in the left direction 123*b* (FIG. 1B), the first selective conduction path 119 placed on the left side of the feeding site 113 may be opened and the second selective conduction path 121 placed on the right side of the feeding site 113 may be short-circuited. Table 1 summarizes, according to the present driving method, how each selective conduction path should be controlled in order to direct the main beam toward the right or left.

TABLE 1

| main beam | corresponding | selective conduction path | |
|---|---|---|---|
| direction | FIG. | first (left) | second (right) |
| right | 1A | conducting | open |
| left | 1B | open | conducting |

Figure 3B:
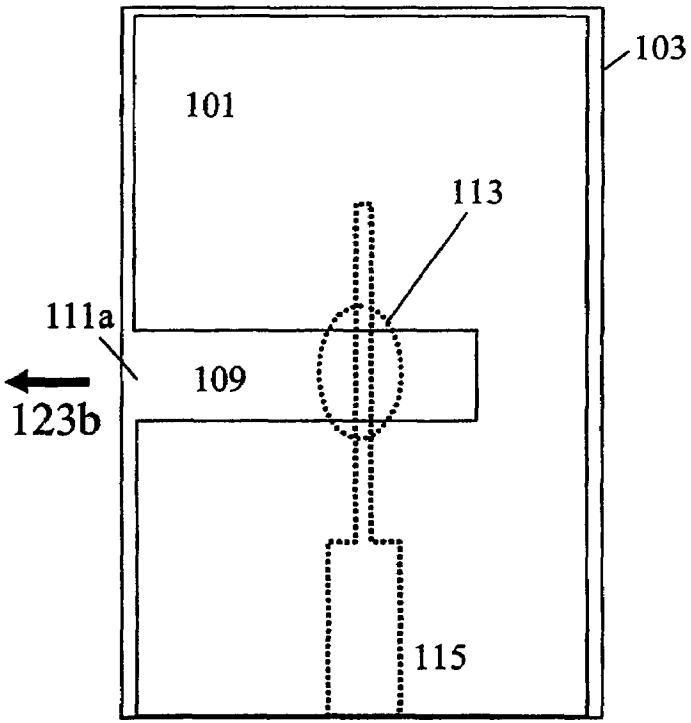
FIGS. 3A and 3B are schematic diagrams of structures which are realized on a variable slot antenna to be driven by the driving method according to the present invention in high-frequency terms.
Figure 3A:
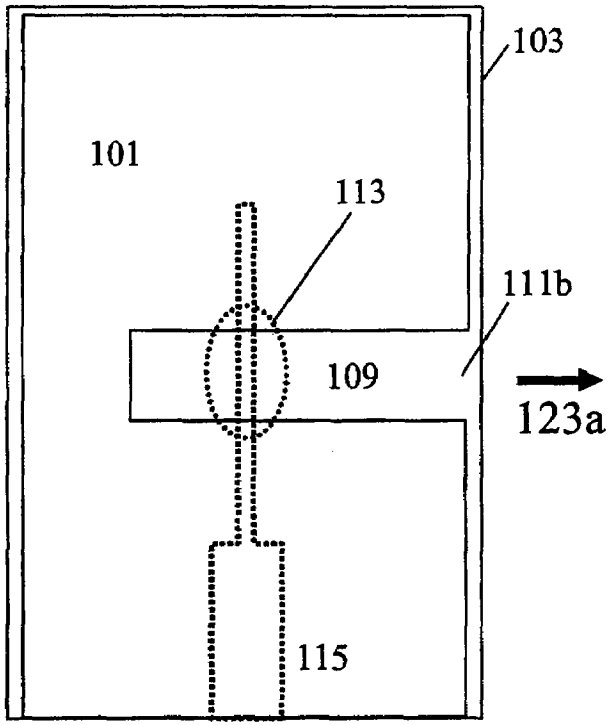

By adopting the driving method according to the present invention, in each driving state, a ¼ effective wavelength slot resonator which is opened on one end and short-circuited on the other appears within the structure, as each conducting selective conduction path locally connects between the split ground conductors 101*a* and 101*b*. FIGS. 3A and 3B schematically show structures which are realized in high-frequency terms on the variable slot antenna being driven into the states of FIGS. 1A and 1B, respectively.

As described above, both ends of the slot region of a variable slot antenna to be driven by the driving method according to the present invention are initially designed as open ends, but in each driving state, one end can be regarded as being short-circuited in high-frequency terms. For example, in FIG. 3A, the open end 111*a* (which is illustrated in FIG. 1A) is omitted from illustration. This is because, when the first selective conduction path 119 disposed in the direction of the open end 111*a* as viewed from the feeding site 113 is controlled to conduct, the open end 111*a* as viewed from the feeding site 113 becomes ignorable in high-frequency terms. Moreover, when the second selective conduction path 121 is in an open state in high-frequency terms, only a very limited influence of the specific shape, etc., of the second selective conduction path 121 is exerted on the radiation characteristics, so that FIG. 1A can be approximated in high-frequency terms as shown in FIG. 3A. Similarly, the variable slot antenna in the driving state of FIG. 1B can be approximated in high-frequency terms as shown in FIG. 3B. The main beam direction obtained when feeding the ¼ effective wavelength slot resonator is a direction of an open end from the feeding site. Therefore, the driving method according to the present invention is able to realize a drastic switching of the main beam direction, because the direction of an open end as viewed from the feeding site can be switched based on the driving state.

Figure 4:
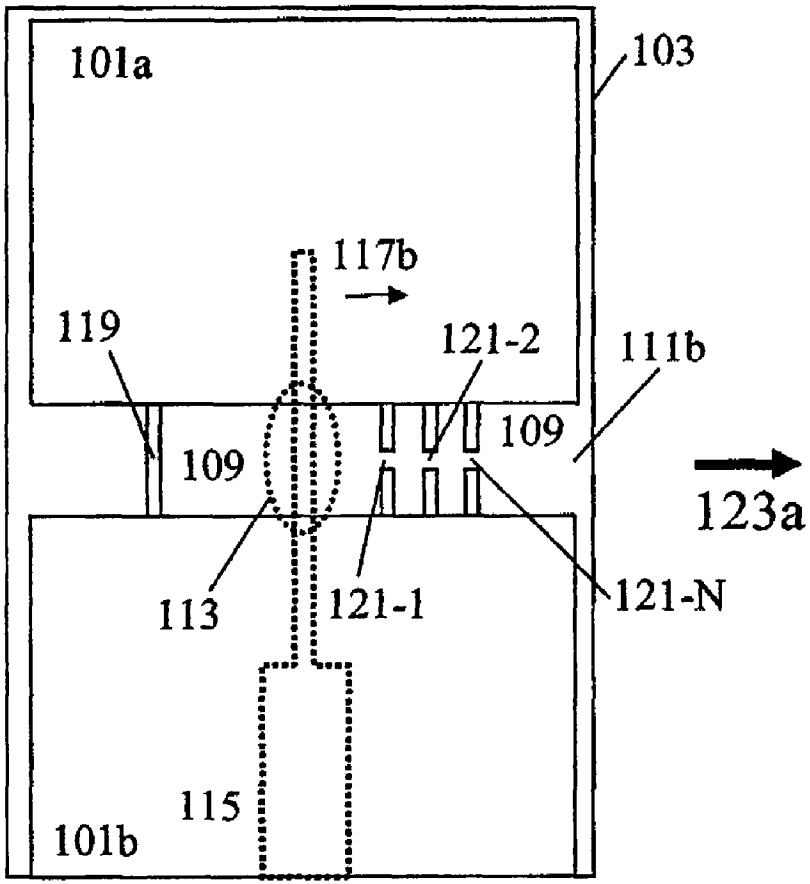
FIG. 4 is a lower schematic see-through view of a variable slot antenna to be driven by the driving method according to the present invention.
Figure 5:
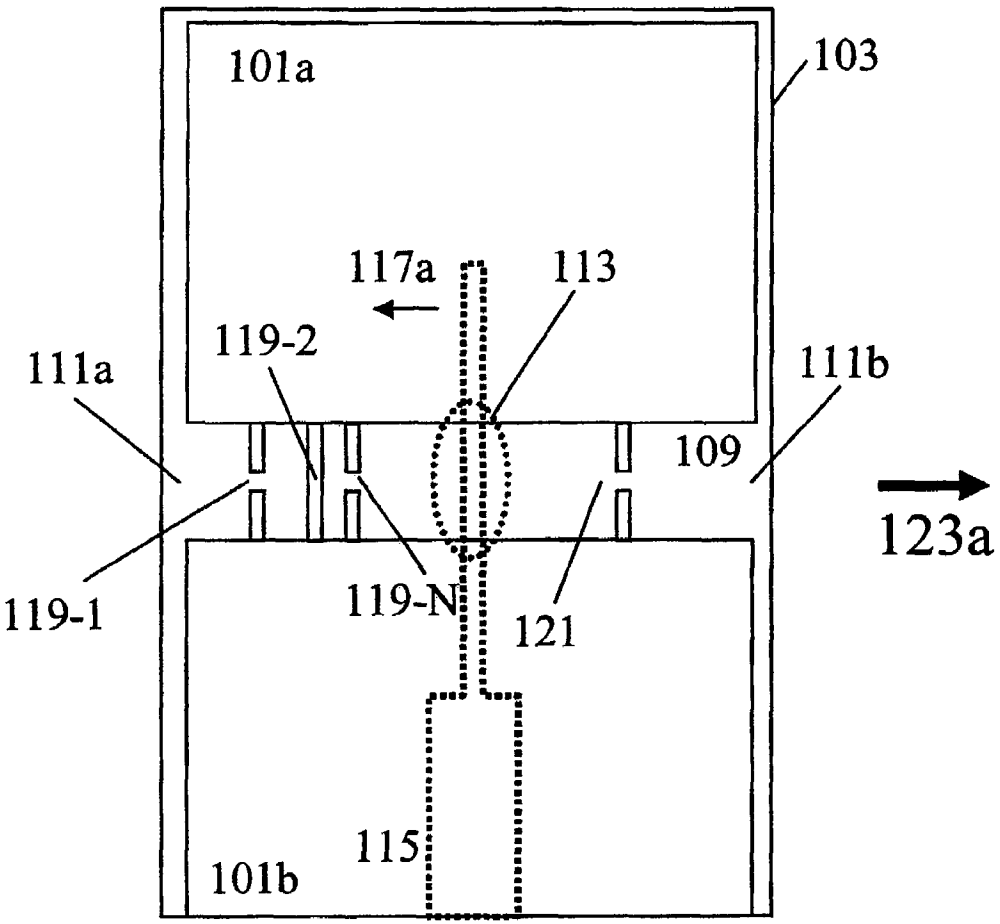
FIG. 5 is a lower schematic see-through view of a variable slot antenna to be driven by the driving method according to the present invention.

According to the above principles, as shown in FIG. 4 and FIG. 5, when a plurality of selective conduction paths (rather than one selective conduction path) are disposed toward an open end 111*a* or 111*b* of the slot region 109 as viewed from the feeding site 113 in a variable slot antenna which is driven by the driving method according to the present invention, the driving method becomes more limited. First, as shown in FIG. 4, when it is desired to direct the main beam toward the right (i.e., the direction of arrow 123*a*), if a plurality of second selective conduction paths 121-1, 121-2, . . . , and 121-N are provided in the direction of the open end 111*b* as viewed from the feeding site 113 (i.e., the direction 117*b*), then all of the second selective conduction paths 121-1, 121-2, . . . , and 121-N are controlled to be open. On the other hand, as shown in FIG. 5, when it is desired to direct the main beam toward the right (direction of arrow 123*a*), if a plurality of first selective conduction paths 119-1, 119-2, . . . , and 119-N are provided in the direction of the open end 111*a* as viewed from the feeding site 113 (i.e., the direction 117*a*), then at least one of the first selective conduction paths 119-1, 119-2, . . . , and 119-N may be controlled to conduct. FIG. 5 shows a state where only the second selective conduction path 119-2 is controlled to conduct. Based on the selection of the conducting selective conduction path, it becomes possible to adjust the resonator length of the resultant slot resonator. Moreover, selection of the conducting selective conduction path also makes it possible to adjust the feeding impedance for the slot resonator. It will be appreciated that all of the selective conduction paths may be allowed to conduct.

(Selective Conduction Paths)

The conduction between the first ground conductor 101*a* and the second ground conductor 101*b* which is realized by the first and second selective conduction paths does not need to be conduction in terms of DC signals, but may merely be conduction in high-frequency terms such that the passband is limited to near the operating frequency. Specifically, in order to implement the selective conduction paths according to the present invention, any switching elements that provide low-loss and high-separation characteristics in the antenna operating band may be used, e.g., diode switches, high-frequency transistors, high-frequency switches, or MEMS switches. Using diode switches will simplify the construction of the feed circuit.

Figure 6B:
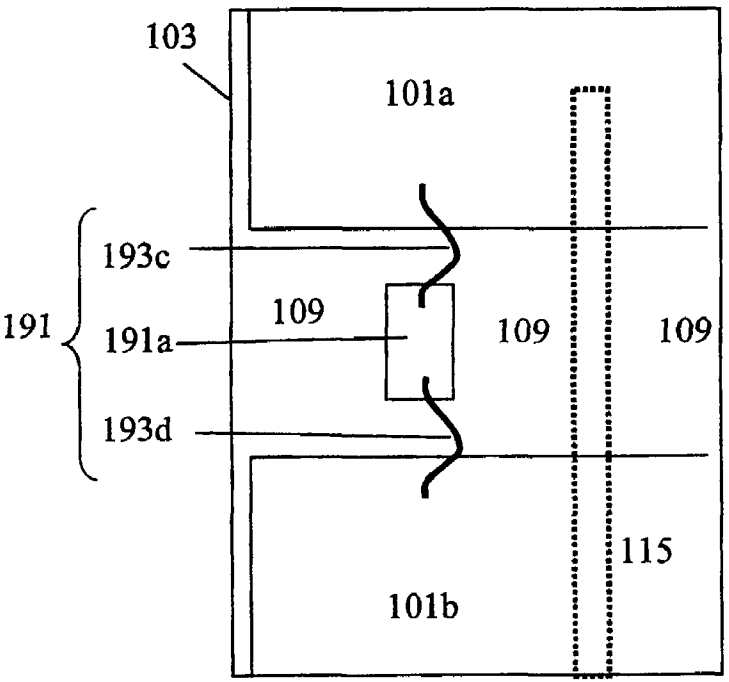
FIGS. 6A and 6B are enlarged views near a selective conduction path according to the present invention.
Figure 6A:
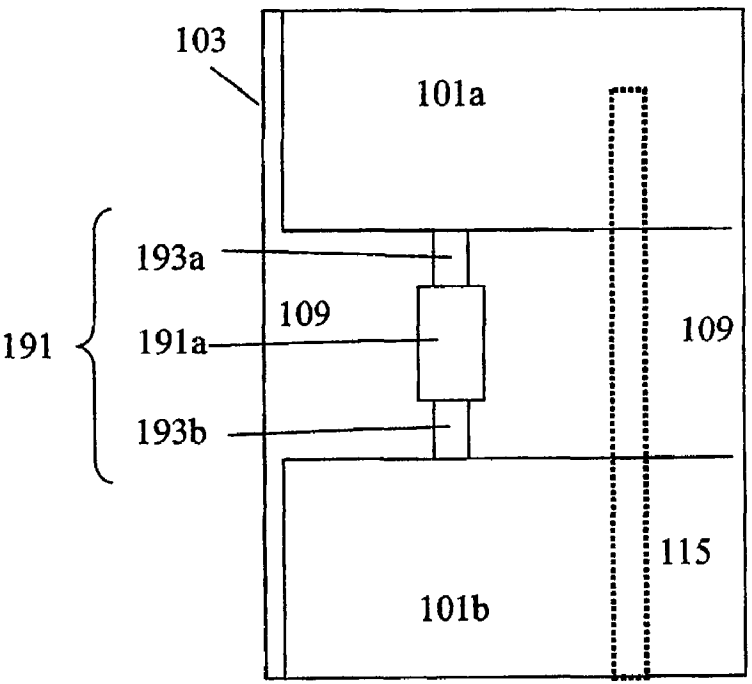
Figure 7:
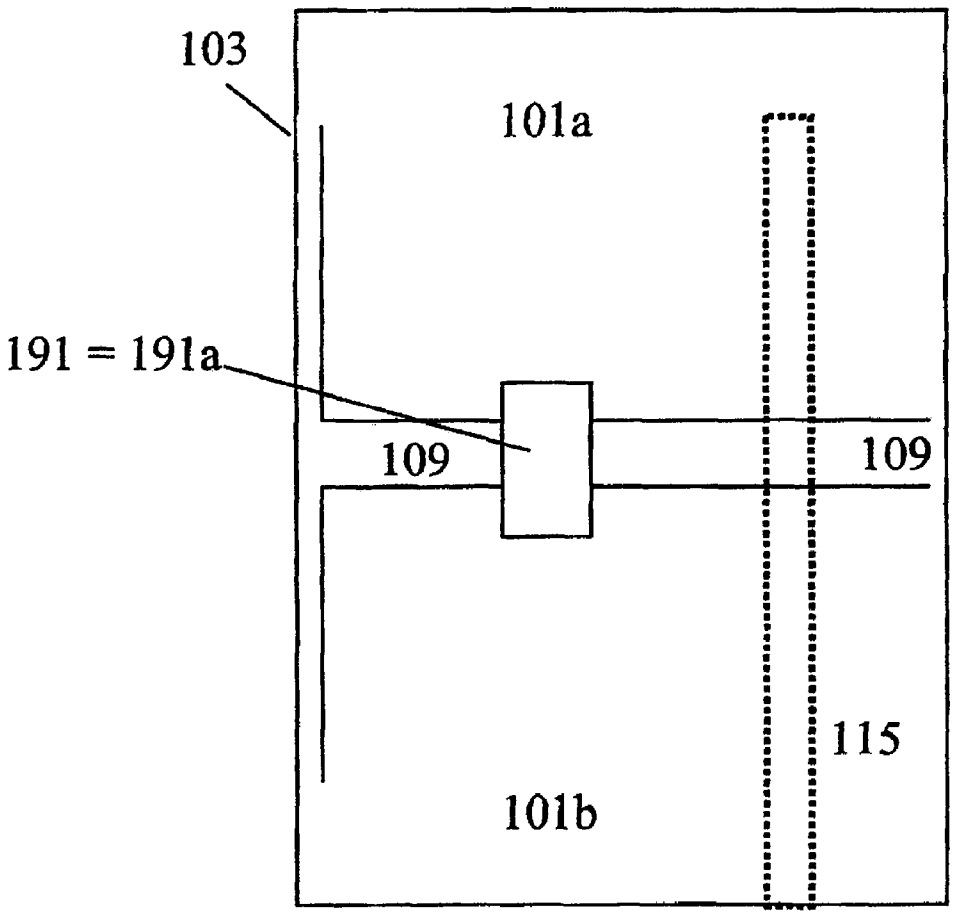
FIG. 7 is an enlarged view near a selective conduction path according to the present invention.

FIGS. 6A and 6B are schematic diagrams showing exemplary implementations of selective conduction paths for use in the present invention (with the neighboring lower face structure being shown enlarged), especially with respect to the case where the width of the slot region 109 is wider than the size of the switching element. As shown in FIG. 6A, the selective conduction path 191 may be composed of: a switching element 191*a* capable of switching between conducting and open states of a high-frequency signal; and conductors 193*a* and 193*b* in the form of projections on both sides of the switching element 191*a*. The conductors 193*a* and 193*b* are shaped so as to project into the slot region 109 from the ground conductors 101*a* and 101*b*, respectively. One of the conductors 193*a* and 193*b* may be omitted from the structure so that the switching element 191*a* is directly connected to either ground conductor 101*a* or 101*b*. Alternatively, as shown in FIG. 6B, instead of conductors 193*a* and 193*b*, conductor wires 193*c* and 193*d* may be used to provide connection between the ground conductor 101*a* and the switching element 191*a* and between the ground conductor 101*b* and the switching element 191*a*. On the other hand, FIG. 7 shows an exemplary implementation of the selective conduction path 191 (as an enlarged view of the neighborhood of only a selective conduction path) in the case where the size of the switching element 191*a* is larger than the width of the slot region 109. In either case, the selective conduction path in a variable slot antenna to be driven by the driving method according to the present invention is a structure which is formed so as to straddle the slot region in a manner of connecting between the ground conductors 101*a* and 101*b*, with a switching element being inserted in series within the path, such the switching element is capable of controlling the two states of conducting or open in high-frequency terms. When the switching element in the path is opened, the selective conduction path functions in an open state in high-frequency terms. When the switching element in the path is controlled to conduct, the selective conduction path functions in a conducting state in high-frequency terms. Since any switching element that is used in a high-frequency band will have a parasitic circuit component depending on its structure, strictly speaking, it is impossible to realize a completely-open state or a completely-conducting state. By designing the circuitry while taking the parasitic circuit components into consideration, the objective of the present invention can be easily attained. For example, commercially-available gallium arsenide PIN diode switches, which are used in the Examples of the present invention, have a series parasitic capacitance of 0.05 pF, and thus make it possible to obtain separation characteristics that are sufficient for the purpose of the present invention, e.g., about 25 dB in the GHz band in an open state. Even if the variable slot antenna to be driven by the driving method according to the present invention is designed without taking this value into consideration, there will be no large change in the characteristics. Moreover, the aforementioned commercially-available diode switches have a series parasitic resistance of 4Ω, thus resulting in a loss value of about 0.3 dB in the GHz band in a conducting state, and providing low-loss characteristics which are sufficient for the purpose of the present invention. Thus, even if a variable slot antenna is driven by the driving method according to the present invention while ignoring this value, as if an ideal switching element were installed, it would be possible to ignore deterioration in characteristics such as radiation efficiency of the antenna. Thus, the selective conduction paths to be used in the present invention can be easily implemented by traditional circuit technology.

(Orientation of Slot Region)

The main beam direction of a variable slot antenna to be driven by the driving method according to the present invention can be changed depending on the direction in which the slot is formed. That is, by orienting the direction of an open end of the slot as viewed from the feeding so as to be slightly downward, the main beam direction of the emitted electromagnetic waves can also be oriented slightly downward.

(Symmetry of Construction)

The shape of a variable slot antenna to be driven by the driving method according to the present invention does not need to be mirror symmetrical. However, it may be of an especially high industrial value to provide an antenna which has the switchability of switching the main beam direction alone while maintaining the same return characteristics, same gain characteristics, and same polarization characteristics between two states. Therefore, it is preferable that the shape of the slot region 109, the shapes of the feed line 115, and the shapes of the ground conductors 101*a* and 101*b* are mirror symmetrical. Moreover, in order to ensure that the main beam directions are antiparallel between the first state and the second state, it is preferable that the first direction and the second direction are opposite but parallel directions.

(Examples of Other Shapes for Slots)

Figure 8:
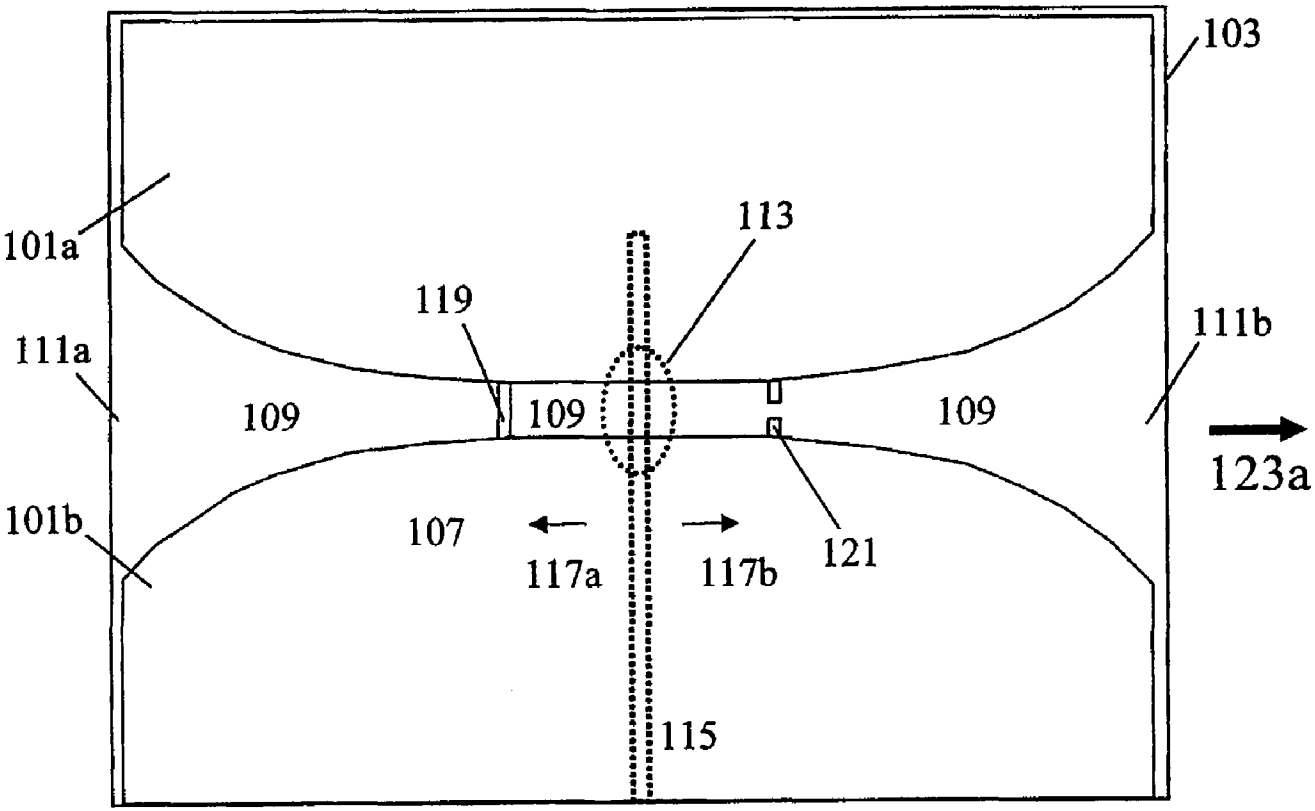
FIG. 8 is a lower schematic see-through view of a variable slot antenna to be driven by the driving method according to the present invention.

In a variable slot antenna to be driven by the driving method according to the present invention, the shape of the slot region does not need to be rectangular, but each border line with a ground conductor region may be replaced with any arbitrary linear or curved shape. For example, as shown in FIG. 8, the shape of the slot region may be configured so that the slot width has a tapered increase near each open end. Near an upper limit frequency of the operating band, the beam width is determined by a radiation aperture plane of the antenna. Therefore, increasing the slot width near each open end makes it easier to realize a high-gain directive beam.

Figure 9:
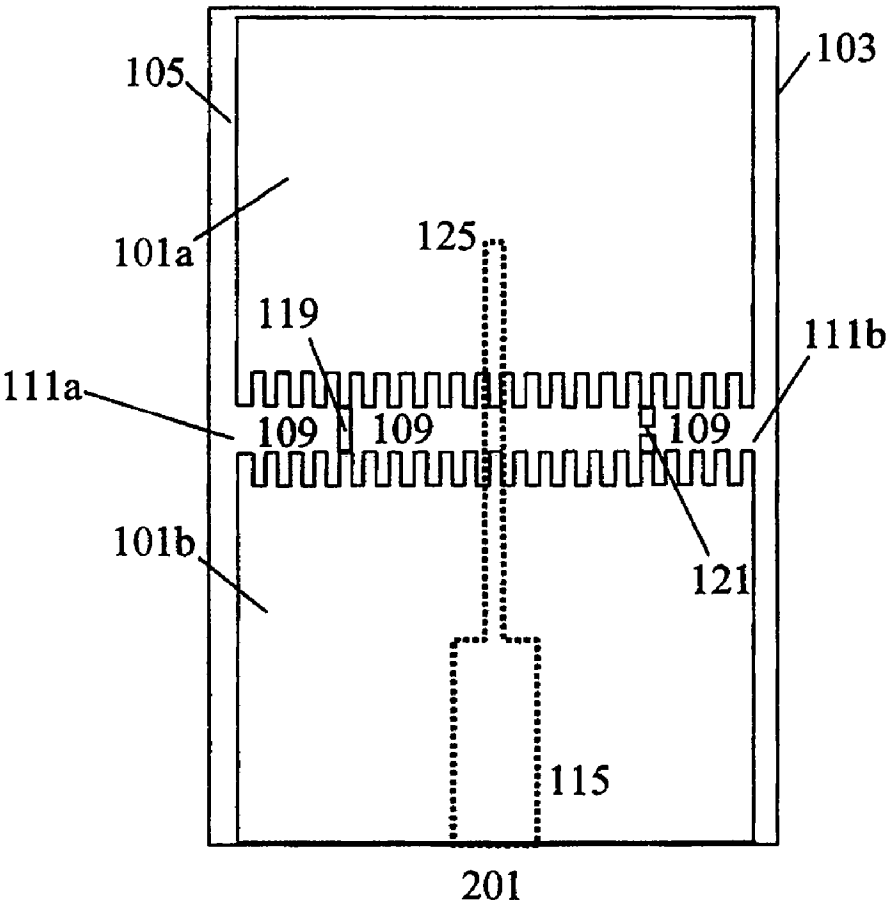
FIG. 9 is a lower schematic see-through view of a variable slot antenna to be driven by the driving method according to the present invention.

Alternatively, as shown in FIG. 9, a multitude of thin and short slots may be connected in parallel to the main slot region (i.e., small contiguous protrusions and depressions may be provided on one opposing side of the four sides of each of the ground conductors 101*a* and 101*b*, which are generally rectangular). This results in an effect of adding a series inductance to the main slot region, thus providing the practically preferable effects of realizing an effective reduction in slot length and a downsizing of the circuitry. Further alternatively, also with a variable slot antenna structure in which the main slot region is given a narrow slot width and folded into a meandering shape or the like for downsizing, the main beam direction switching effect by the driving method according to the present invention can be obtained.

(Slot Resonator)

Regarding the slot resonator which appears on the circuit in each driving state, when the slot width Ws (i.e., the distance between the first ground conductor 101*a* and the second ground conductor 101*b*) is negligibly narrow relative to the slot resonator length Ls (i.e., generally when Ws is (Ls/8) or less), the slot length Ls is prescribed equal to a ¼ effective wavelength near the center frequency f0 of the operating band. In the case where the slot width Ws is wide and non-negligible relative to the slot resonator length Ls (i.e., generally when Ws exceeds (Ls/8)), a slot length which takes the slot width into consideration (Ls×2+Ws) may be prescribed equal to a ½ effective wavelength at f0.

The slot resonator length Ls is defined as a distance from a conducting selective conduction path (119 or 121), astride the feed line 115 and the feeding site 113, to an opening 111. Note that, in the case where more than one selective conduction path is provided on either side, as shown in FIG. 4, Ls is defined as a distance from a switch 121 that is the closest to the feed line 115, astride the feed line 115 and the feeding site 113, to the opening 111, strictly speaking.

(Treatment of Feed Line Open End and Multiple Resonance Structure)

Figure 10B:
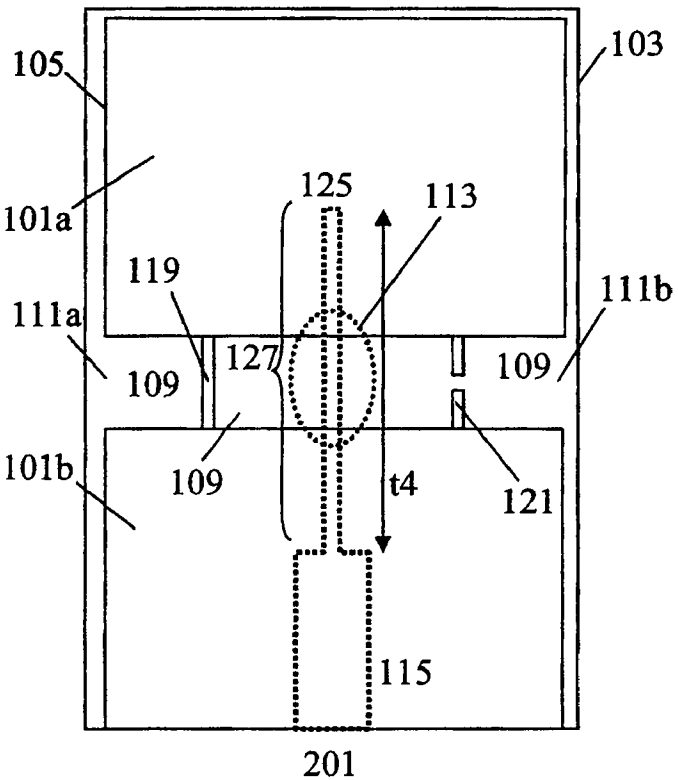
FIGS. 10A and 10B are lower schematic see-through views of variable slot antennas to be driven by the driving method according to the present invention.
Figure 10A:
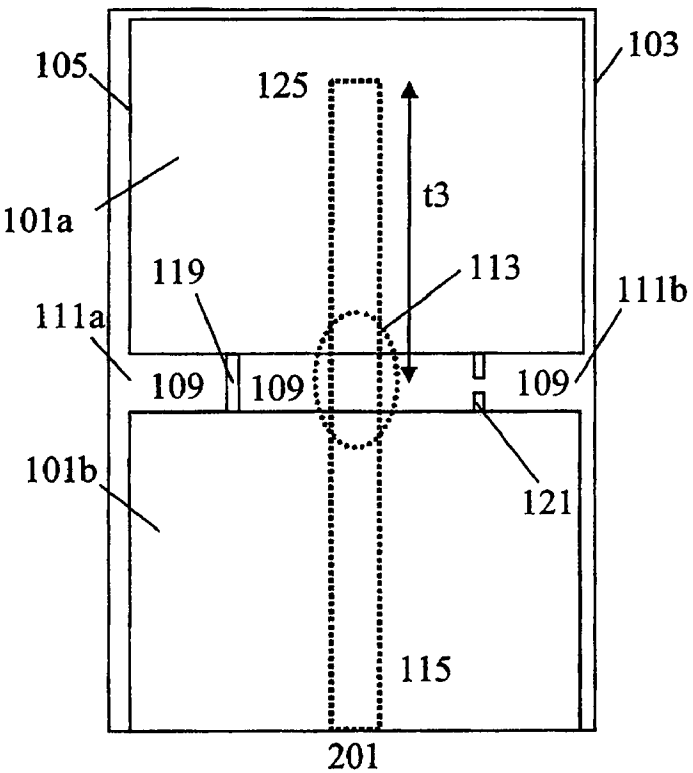

Two characteristic embodiments concerning the shape of the feed line are shown in FIGS. 10A and 10B. A feed line 115 at least partially intersecting the slot 109 is formed on the front face of the dielectric substrate 103, one end being connected to an input/output circuit at an input/output terminal 201, and the other end being left open-ended at an end point 125. As shown in FIG. 10A, a distance t3 from the end point 125 to the feeding site 113 may be prescribed equal to a ¼ effective wavelength at the frequency f0, whereby good matching characteristics can be obtained in the operating band. In this case, the line width of the feed line 115 from the end point 125 to the feeding site 113 may be the same as the line width near the input/output terminal 201, e.g., so as to have a characteristic impedance of 50Ω. Good matching can also be obtained by adopting other values.

On the other hand, in the embodiment that has been illustrated with reference to FIG. 1 and other figures, as shown in FIG. 10B, a feed line region spanning a length t4 from the end point 125 is replaced with an inductive resonator region 127 having a thinner line width, and the intersection between the feed line 115 and the slot 109 is set at the substantial center of the inductive resonator region 127 along the longitudinal direction. T4 is prescribed equal to a ¼ effective wavelength at the frequency f0. In other words, at its leading end, the feed line 115 is composed of a line having a characteristic impedance which is higher than 50Ω, spanning a length (t4) equal to a ¼ effective wavelength at the center frequency of the operating band from the open end point 125. This portion spanning the length t4 functions as an inductive resonator region 127, with the feed line 115 intersecting the slot region at the central portion of the inductive resonator region 127.

In accordance with the construction of FIG. 10B, a ¼ effective wavelength slot resonator and a ¼ effective wavelength inductive resonator are coupled, whereby a multiple resonance operation is realized (i.e., the operating band is effectively expanded), which is practically effective.

The end point 125 may be grounded via a resistor to obtain wideband matching characteristics. Similarly, the line width of the feed line 115 may be gradually increased near the end point 125, so as to result in a radial end shape, thus to obtain wideband matching characteristics.

Moreover, an additional dielectric 129 may be loaded at the open end 111*a* or 111*b*, for example, thus changing the radiation characteristics of the slot antenna. Specifically, the main beam half-width characteristics during wideband operation or the like can be controlled.

Multilayer Structure Embodiments

Figure 11A:
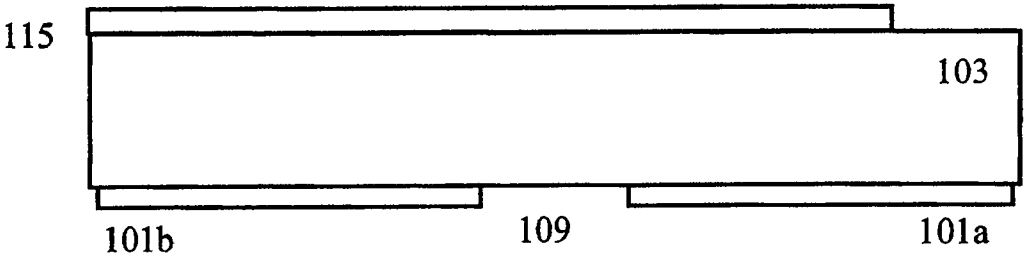
FIGS. 11A to 11C are cross-sectional structural diagrams of variable slot antennas to be driven by the driving method according to the present invention.
Figure 11B:
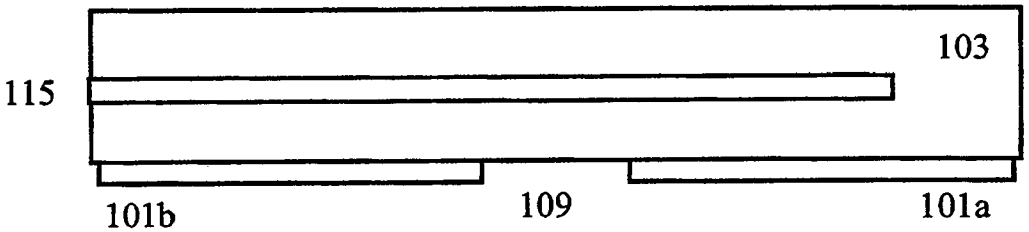
Figure 11C:
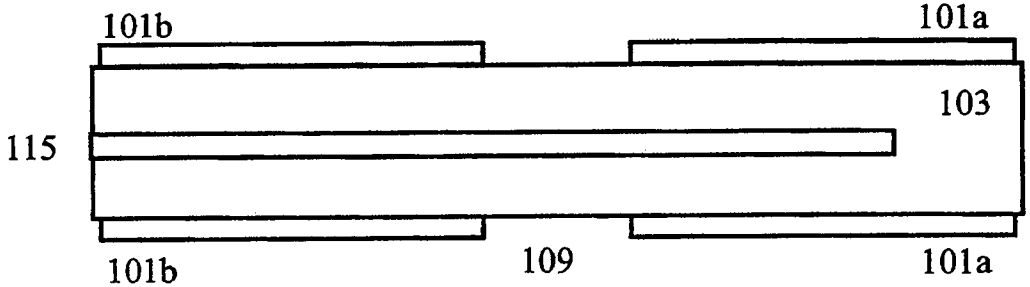

The present specification has illustrated a structure, as shown in the cross-sectional view of FIG. 11A, in which the feed line 115 is disposed on the frontmost face of the dielectric substrate 103 and the ground conductor 101 is disposed on the rearmost face of the dielectric substrate 103. However, as illustrated in FIG. 11B showing a cross-sectional view of another embodiment, by methods such as adopting a multilayer substrate, either or both of the feed line 115 and the ground conductor 101 may be disposed at an inner layer plane of the dielectric substrate 103. Moreover, it is not a limitation that there is one conductor wiring surface functioning as a ground conductor 101 for the feed line 115 within the structure. As illustrated in FIG. 11C showing a cross-sectional view of another embodiment, a structure may be adopted in which opposing ground conductors 101 sandwich a layer in which the feed line 115 is formed. In other words, the driving method for the variable slot antenna according to the present invention can provide similar effects in the case of a variable slot antenna having a strip line structure, as well as a variable slot antenna having the microstrip line structure. Note that, in the present invention, a "slot" is defined as a structure in which the conductor layer composing the ground conductor 101 is completely removed along the thickness direction. In other words, a structure in which the ground conductor 101 is merely ground off its surface in a partial region to result in a reduced thickness is not a "slot".

(Differences from Patent Document 3)

Figure 12:
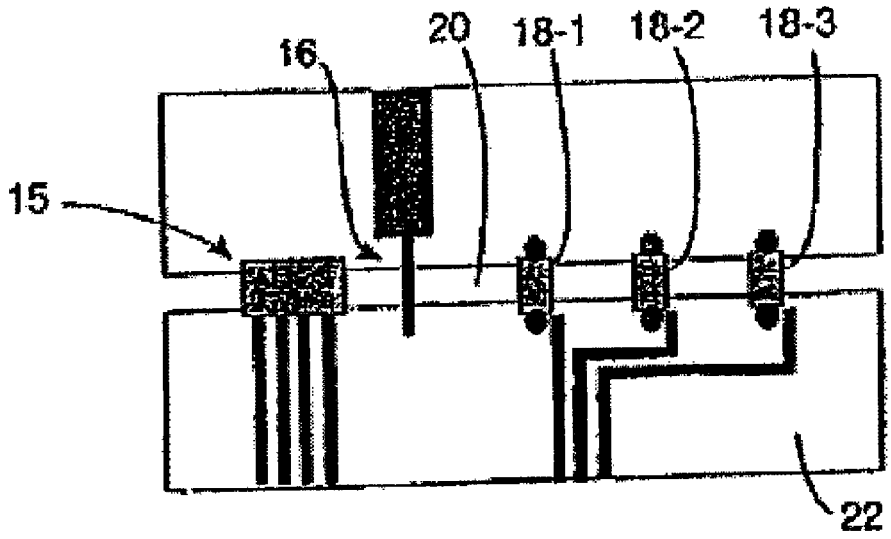
PRIOR ART FIG.12
FIG. 12 is a structural diagram of a variable antenna which is disclosed in FIG. 7 of Patent Document 3 (U.S. Pat. No. 6864848; directed to the same subject matter as Japanese National Phase PCT Laid-Open Publication No. 2005-514844).

Patent Document 3 (U.S. Pat. No. 6,864,848; directed to the same subject matter as Japanese National Phase PCT Laid-Open Publication No. 2005-514844) discloses a ½ effective wavelength slot antenna whose characteristics are adjusted by using MEMS switches. The slot antenna shown in FIG. 12, which is disclosed in FIG. 7 and the like of Patent Document 3, may appear similar in structure to a variable slot antenna to be driven by the driving method according to the present invention. However, the driving method for a variable slot antenna according to the present invention differs from the subject matter of Patent Document 3, with respect to all of: objectives, how the invention is arrived at, high-frequency structure which is realized in the variable slot antenna when being driven, resultant switchability effects, and structure size. The differences between the two will be described below.

First, the slot antenna of Patent Document 3 performs a radiation operation by utilizing a ½ effective wavelength slot resonation mode, whereas a variable slot antenna which is driven by the driving method according to the present invention mainly utilizes a ¼ effective wavelength slot resonation mode. Therefore, the main beam direction of electromagnetic waves emitted from the antenna of Patent Document 3 is always perpendicular to the substrate. The following axes may be assumed in the coordinate system shown in FIG. 12: an X axis which is parallel to the feed line (which is a line for feeding); an XY plane which is parallel to the substrate; and a Z axis which is perpendicular to the substrate. Then, the main beam direction of emission from the ½ effective wavelength slot antenna will always be in the ±Z direction. On the other hand, in a variable slot antenna which is driven by the driving method according to the present invention, one end is always controlled to be open whereas the other end is always controlled to conduct; thus, the slot antenna driving method basically utilizes a ¼ effective wavelength slot resonation mode as its emission principle. Therefore, the main beam direction of emitted electromagnetic waves can be drastically changed to the direction of the selective conduction path which is controlled to be open, as viewed from the feeding site. That is, by using the aforementioned coordinate system, the main beam direction can be drastically changed to the +Y direction or the −Y direction. On the other hand, according to natural principles, Patent Document 3 cannot realize a function of switching the main beam direction.

Figure 13:
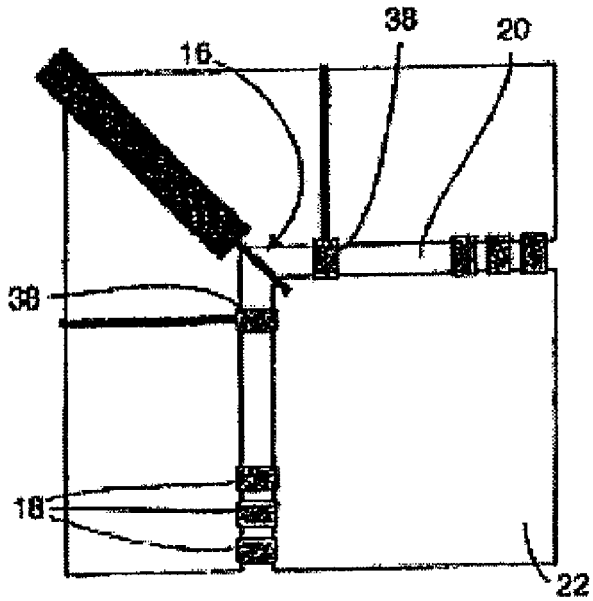
PRIOR ART FIG.13
FIG. 13 is a structural diagram of a variable antenna which is disclosed in FIG. 9 of Patent Document 3.

FIG. 13 shows an embodiment which is disclosed in FIG. 9 of Patent Document 3, where it is possible to select from two slot states at 90° directions. In this case, too, the main beam direction is always in the ±Z direction, and it is only the polarization characteristics of the emitted electromagnetic waves in the main beam direction (i.e., the orientation of the electric field of emitted electromagnetic waves) that are switchable. Thus, the effect of drastically switching directivity as in the present invention cannot be provided. In other words, in the antenna which is disclosed in Patent Document 3, the direction in which desired waves may arrive is limited to one direction, which makes this antenna very unsuitable for use in a mobile terminal device. This problem is solved in a variable slot antenna which is driven by the driving method according to the present invention.

Furthermore, not only with respect to the main beam direction switching effect, but the differences between a variable slot antenna which is driven by the driving method according to the present invention and the slot antenna of Patent Document 3 are also clear with respect to the two aspects of size and frequency band. Patent Document 3 utilizes a ½ effective wavelength slot resonation mode for antenna operation. On the other hand, a variable slot antenna which is driven by the driving method according to the present invention basically utilizes a ¼ wavelength resonation slot mode, thus resulting in the slot length being halved. Moreover, the operating band of a ½ effective wavelength slot antenna is limited to about 10% in terms of bandwidth ratio (which is a value obtained by normalizing the operating band width Δf with the center frequency f0 of the operating band). On the other hand, a ¼ wavelength slot antenna has a low emission Q value, and therefore is expected to provide wideband bandwidth ratio characteristics of at least 15% to 20%. The reason why the slot antenna of Patent Document 3 should bother to incorporate MEMS switches to impart variable characteristics to the slot antenna is for a fine adjustment of the operating frequency. However, in the driving method according to the present invention, which realizes a ¼ effective wavelength slot antenna within the antenna structure, the need for a fined adjustment of the operating frequency never exists to begin with; thus, the objectives of the present invention do not relate to those of Patent Document 3 in any way.

According to Patent Document 3, the reason why a slot region with open both ends is provided, despite the fact that the ground conductors will eventually be interconnected at both ends of the slot resonator via MEMS switches, is to allow the RF-MEMS switches, which are disposed close to the open ends, to provide maximum tunability. In other words, as compared to a usual slot antenna in which separate ground conductors are completely interconnected via a metal material, a high input impedance for a high-frequency current is presented when ground conductors are interconnected via RF-MEMS switches. If connection between ground conductors is established via a conductor near an RF-MEMS switch, changes in high-frequency characteristics will not clearly appear even if the RF-MEMS switch is switched. Patent Document 3 aims to avoid conductor-based connection between ground conductors near the RF-MEMS switches, in order to allow for fine control of the resonant frequency and input impedance. In other words, the subject matter of Patent Document 3 is based merely on a ½ wavelength resonator in which any circuitry other than high-frequency switching elements might as well be used for establishing connection between the finite ground conductors. Thus, the present invention and the subject matter of Patent Document 3 are not only different in terms of the driving method and the antenna structure obtained in each driving state, but they clearly differ in their objectives. Thus, the driving method for a variable slot antenna according to the present invention would not be easily derived from Patent Document 3.

Example

Figure 14:
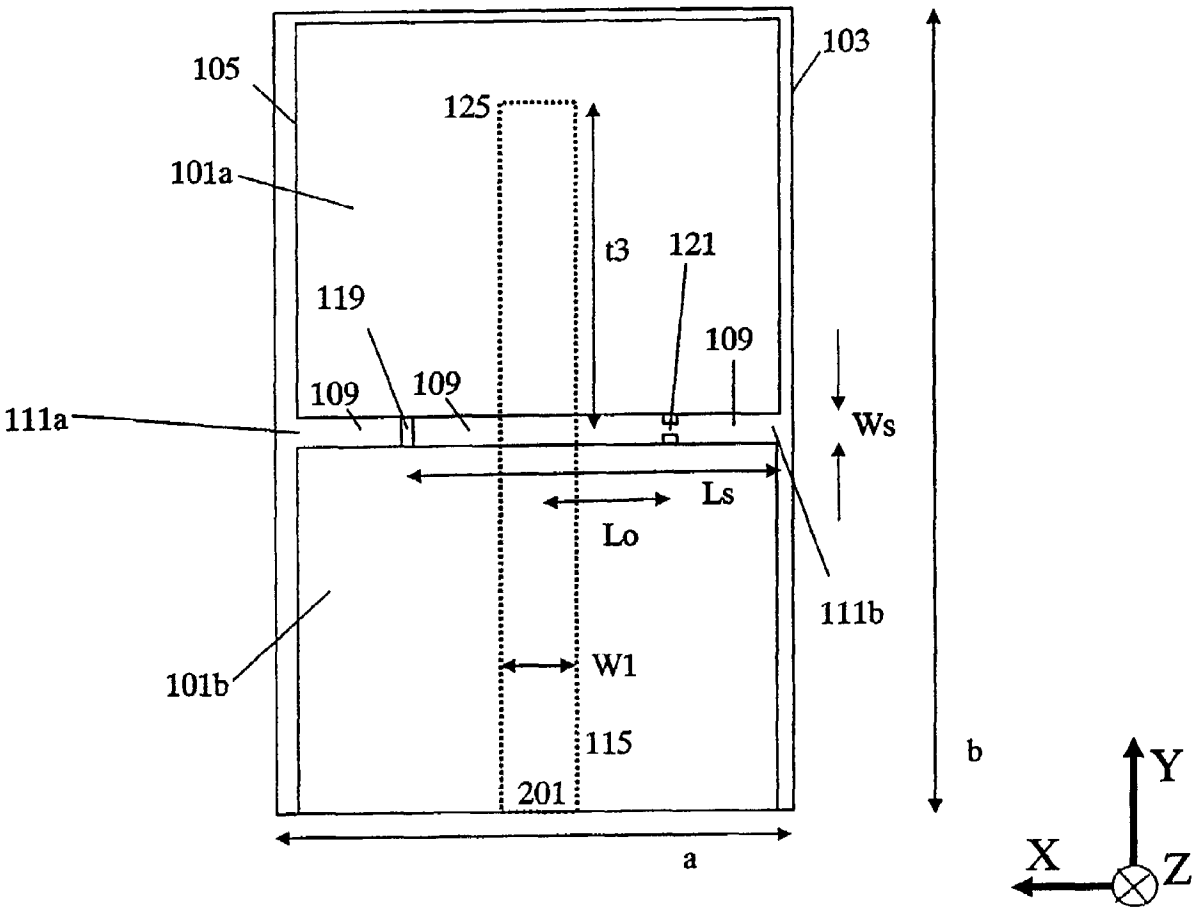
FIG. 14 is a structural diagram of a variable antenna according to Example 1.

A variable slot antenna of Example 1, as shown in a schematic see-through view (through a lower face) of FIG. 14, was produced. As a dielectric substrate 103, an FR4 substrate having an overall thickness of 0.5 mm was used. On the front face and the rear face of the substrate, respectively, a feed line pattern and a ground conductor pattern each having a thickness of 20 microns were formed, by using a copper line. Each wiring pattern was formed by removing some regions of the metal layer through wet etching, and gold plating was provided on the surface to a thickness of 1 micron. The wiring margin was set so that, even at the closest points to the end faces of the dielectric substrate 101, an outer edge 105 of the ground conductor 101 remained inside the dielectric substrate 103 by no less than 0.1 mm from the end faces. In the figure, the ground conductor pattern is shown by a solid line, whereas the feed line pattern is shown by a dotted line. A high-frequency connector was connected to the input terminal 201, and the produced antenna was connected to a measurement system via a feed line 115 having a characteristic impedance corresponding to 50Ω. The ground conductor 101 was separated at the center into finite ground conductor regions 101*a* and 101*b*, sandwiching a slot region 109. Two selective conduction paths 119 and 121 were set astride the slot region 109. As the high-frequency switching elements within the selective conduction paths, commercially-available gallium arsenide PIN diodes were used. The PIN diodes used each had an insertion loss of 0.3 dB at 5 GHz in a conducting state, and a separation of 25 dB at 5 GHz in an open state, which are quite unproblematic values in practice. Via a 1 kΩ resistor, a bias circuit was connected to the ground conductor region 101*b*, thus realizing biasing for the diode. By placing the diodes in the selective conduction paths 119 and 121 in opposite polarities, a driving mode was set so that, while one of the selective conduction paths 119 and 121 was operating to conduct, the other would be operating to be open. The structural parameters of Example 1 shown in FIG. 19 are summarized in Table 2, against the structural parameters of Comparative Example 1.

TABLE 2

| | |
|---|---|
| W1 | 0.85 mm |
| Ls | 14 mm |
| Ws | 0.4 mm |
| a | 20 mm |
| b | 45 mm |
| Lo | 3 mm |
| t3 | 14 mm |

Figure 15:
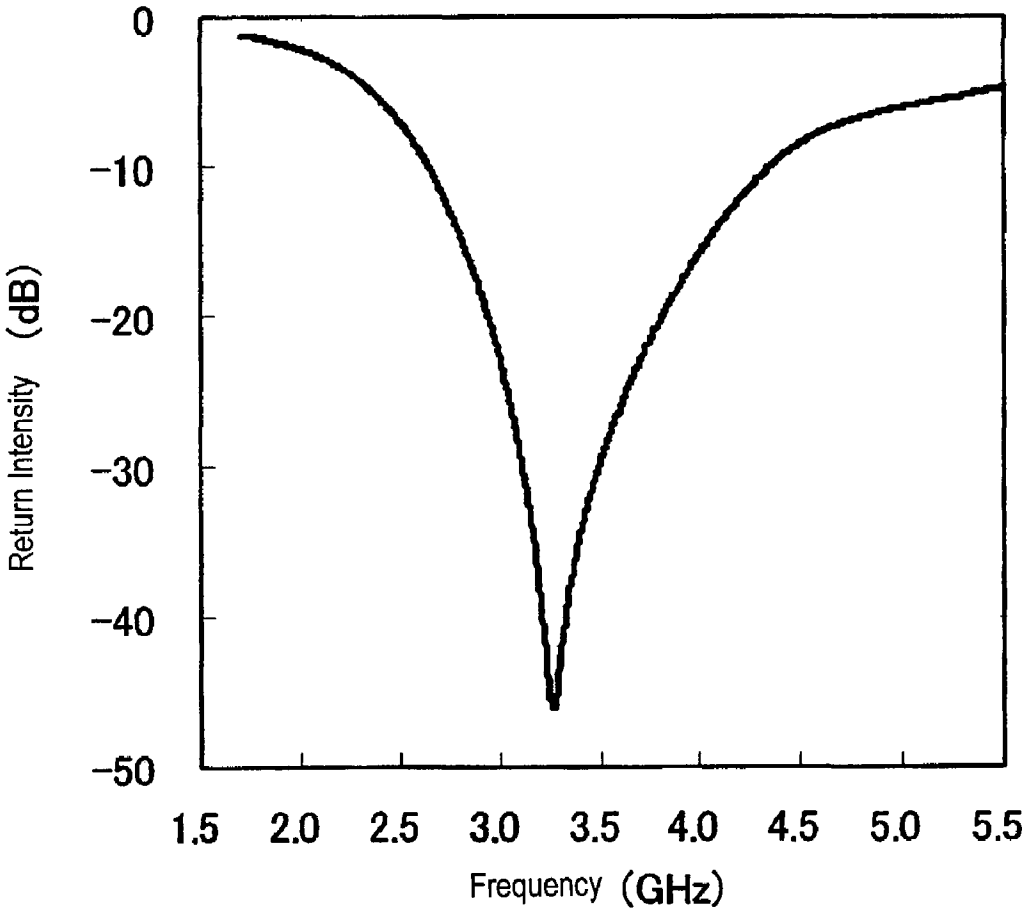
FIG. 15 is a frequency dependence graph of return characteristics of the variable antenna of Example 1.
Figure 16B:
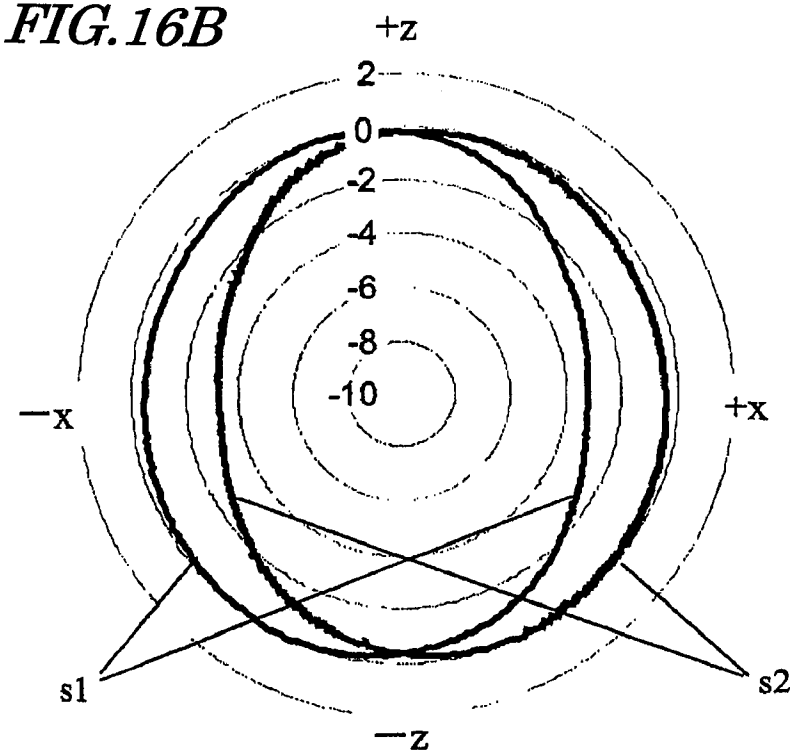
FIGS. 16A and 16B are radiation characteristics diagrams of the variable antenna of Example 1.
Figure 16A:
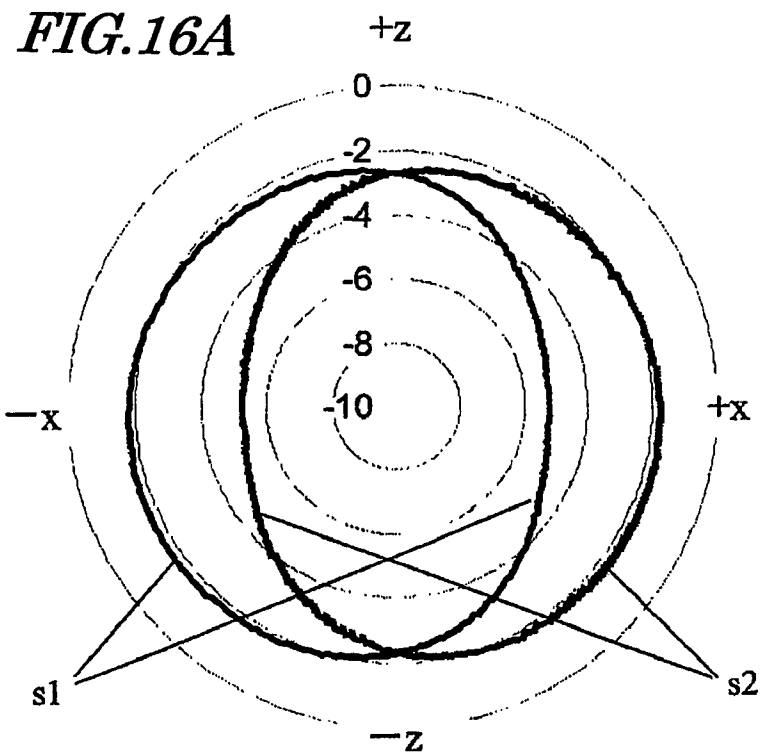

In the first driving state, by allowing the selective conduction path 119 to conduct and allowing the selective conduction path 121 to open, emission in the −X direction in the coordinate system in the figure was obtained across a wide frequency band. FIG. 14 corresponds to a schematic structural diagram in the first driving state. In the second driving state, an opposite bias was supplied to the ground conductor region, and by allowing the selective conduction path 119 to open and allowing the selective conduction path 121 to conduct, an emission in the +X direction was obtained across a wide frequency band. The return characteristics in the first driving state are shown in FIG. 15. In a frequency band from 2.7 GHz to 4.3 GHz, good return characteristics values of −10 dB or less were obtained. The aforementioned band corresponds to a bandwidth ratio of 45%. Also in the second driving state, similar return characteristics were obtained in substantially the same frequency band. FIGS. 16A and 16B show the radiation characteristics in the first driving state and the second driving state, at 3 GHz and 4 GHz, respectively. Shown in these figures are the radiation directivities in the XZ plane in the coordinate system of FIG. 14. In the figures, s1 represents a radiation directivity in the first driving state, whereas s2 represents a radiation directivity in the second driving state. As will be clear from FIGS. 15 and 16A and 16B, while obtaining substantially equivalent and good return characteristics in two states across a wide frequency band, the main beam direction was in the same direction across the wide frequency band, and it was possible to completely switch the main beam direction between two states.

Figure 17:
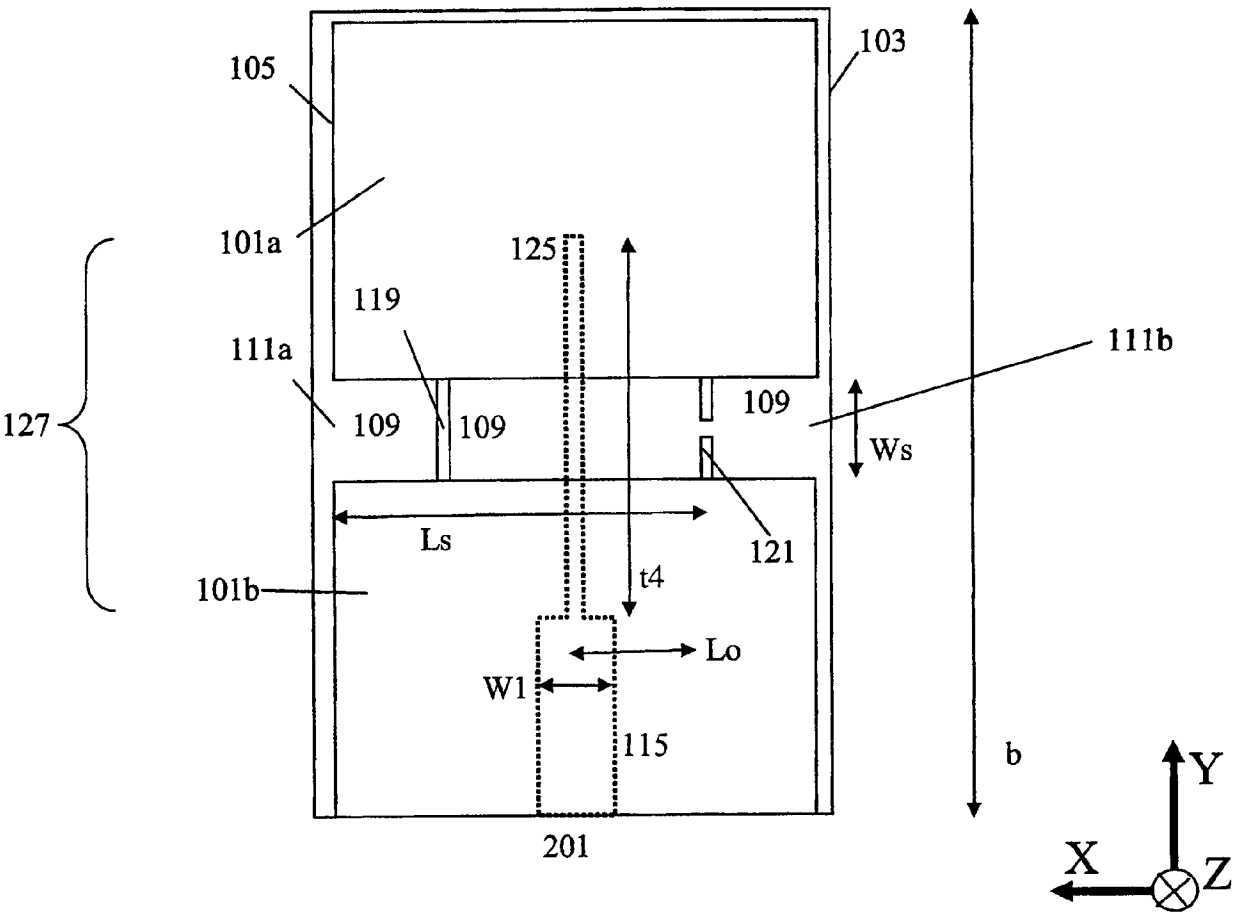
FIG. 17 is a structural diagram of a variable antenna according to Example 2.

Next, a variable slot antenna of Example 2 was produced, as shown in a schematic see-through view (through a lower face) of FIG. 17. The structural parameters of Example are summarized in Table 3. In Example 2, as compared to the structure of Example 1, the feed line 115 of a region corresponding to a ¼ effective wavelength from its open end was replaced by an inductive resonator region 127. Moreover, it was ensured that the central portion of the inductive resonator region 127 corresponded to the slot feeding site. Moreover, the width of the slot region was ten times that in Example 1.

TABLE 3

| | |
|---|---|
| W1 | 0.85 mm |
| WL | 0.45 mm |
| Ls | 14 mm |
| Ws | 4 mm |
| a | 20 mm |
| b | 45 mm |
| Lo | 3 mm |
| t4 | 14 mm |

Figure 18:
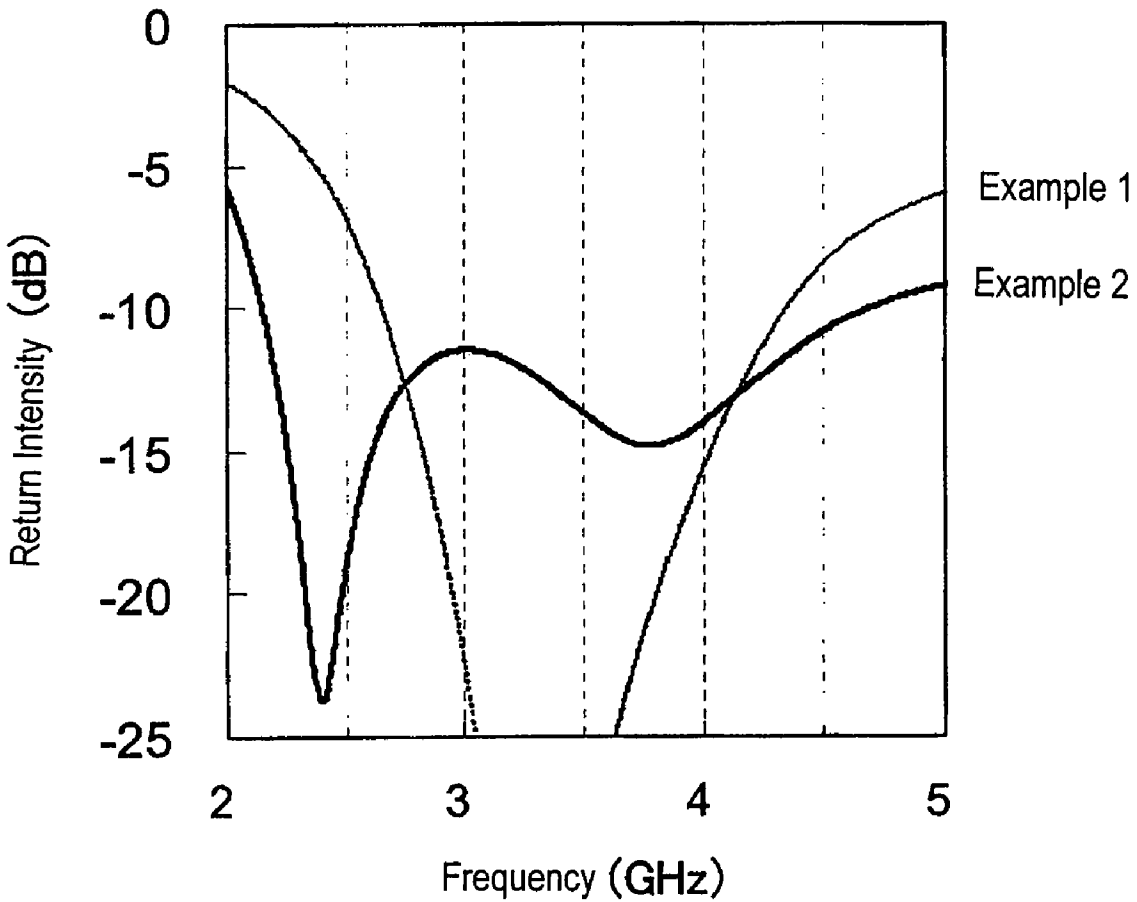
FIG. 18 is a frequency dependence graph of return characteristics of the variable antenna of Example 2.
Figure 19B:
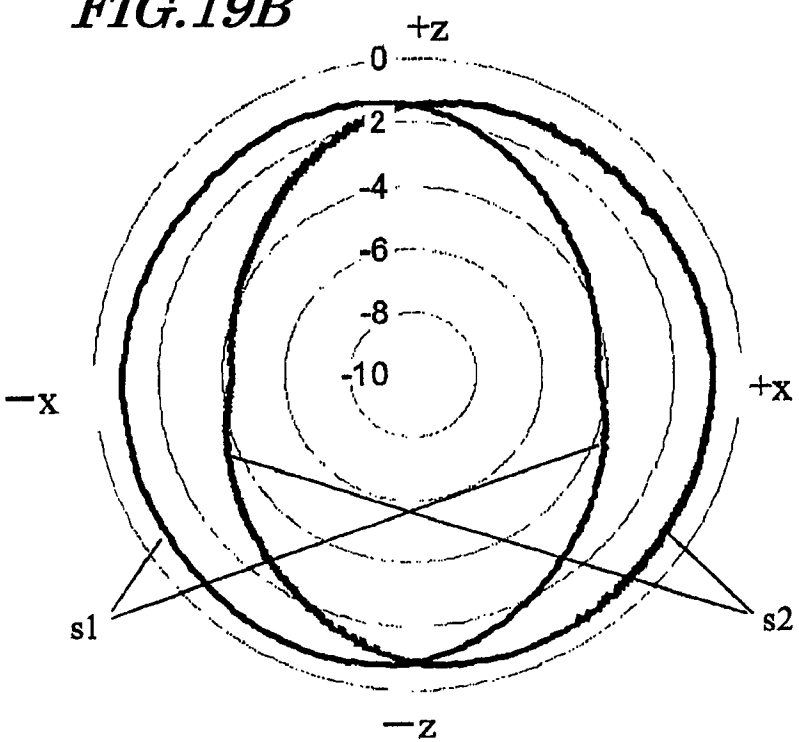
FIGS. 19A and 19B are radiation characteristics diagrams of the variable antenna of Example 2.
Figure 19A:
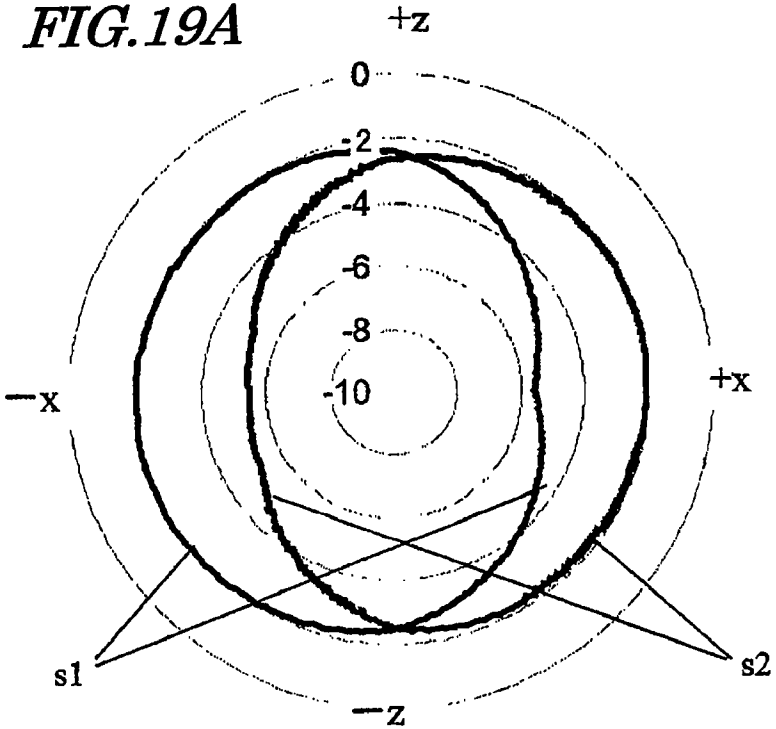
Figure 20:
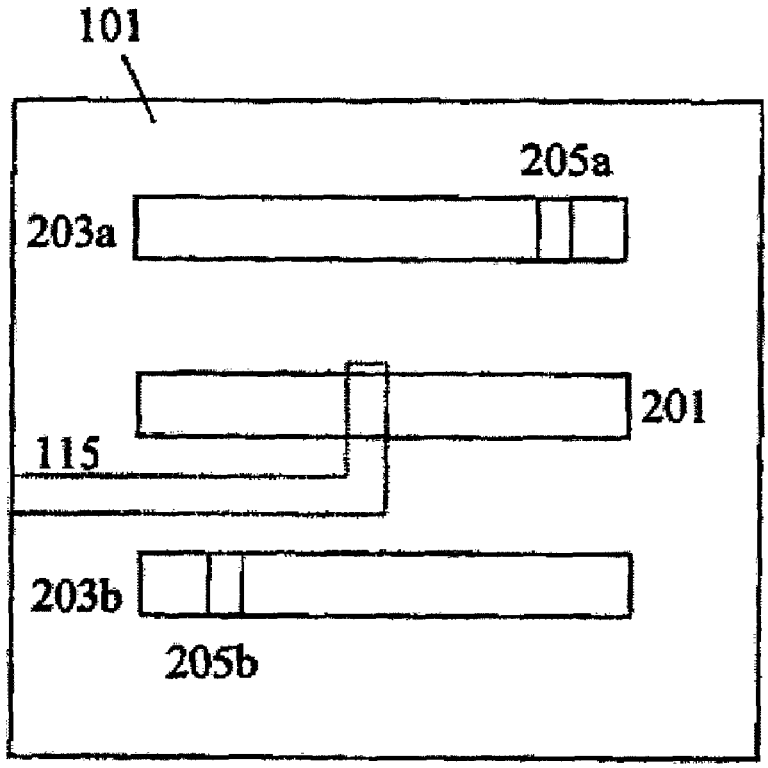
PRIOR ART FIG.20
FIG. 20 is a structural diagram of a variable antenna disclosed in Patent Document 2.

Return characteristics of Example 2 in the first driving state are shown in FIG. 18. Return characteristics in the first driving state of Example 1 are also illustrated in the figure for comparison. In Example 2, a good return loss value of −10 dB or less in a frequency band from 2.2 GHz to 4.7 GHz was obtained. This band corresponds to wideband characteristics of 72% as converted into bandwidth ratio. Also in the second driving state, almost similar return characteristics were obtained. FIGS. 19A and 19B show radiation characteristics of Example 2 in the first driving state and the second driving state, at 2.5 GHz and 4.5 GHz, respectively. Shown in these figures are the radiation directivities in the XZ plane in the coordinate system of FIG. 17. In the figures, s1 represents a radiation directivity in the first driving state, whereas s2 represents a radiation directivity in the second driving state. As will be clear from FIGS. 18, 19A, and 19B, while obtaining substantially equivalent and good return characteristics in two states across a wide frequency band, the main beam direction was in the same direction across a wide frequency band, and it was possible to completely switch the main beam direction between two states.

Thus, it has been illustrated that the driving method according to the present invention realizes a drastic switching function of switching the main beam direction in a variable slot antenna having a small circuit footprint.

According to the present invention, it is possible to attain a function of drastically switching the main beam direction, without an increase in circuit footprint. Thus, with a simple construction, it is possible to realize a multi-functional terminal device which would conventionally have required mounting a plurality of antennas. A variable slot antenna which is realized with the driving method according to the present invention is based on a ¼ effective wavelength slot resonator structure and thus is able to provide wideband characteristics, and can also contribute to the realization of a short-range wireless communication system, which exploits a much wider frequency band than conventionally. The present invention also makes it possible to introduce a small-sized antenna having switchability also in a system which requires ultrawideband frequency characteristics where digital signals are transmitted or received wirelessly.

The technological concept of the present invention to be grasped from the above description shall be as follows.

A variable directivity slot antenna comprising: a dielectric substrate (103); and a ground conductor (101) and a slot region (109) formed on a rear face of the dielectric substrate (103), the ground conductor (101) having a finite area.

The slot region (109) divides the ground conductor (101) into two regions, i.e., a first ground conductor (101*a*) and a second ground conductor (101*b*).

Both leading ends of the slot region (109) are open ends (111*a*, 111*b*).

Two selective conduction paths (119, 121) are further provided on the rear face of the dielectric substrate (103), the two selective conduction paths (119, 121) traversing the slot region (109) to connect the first ground conductor (101*a*) and the second ground conductor (101*b*).

A feed line (115) intersecting the slot region (109) at a feeding site (113) near a center of the slot region (109) along a longitudinal direction thereof is provided on a front face of the dielectric substrate (103).

The two selective conduction paths (119, 121) include a first selective conduction path (119) and a second selective conduction path (121).

In a see-through plan view in which the variable directivity slot antenna is seen through from a normal direction of the dielectric substrate (103), the feed line (115) appears interposed between the first selective conduction path (119) and the second selective conduction path (121).

A slot resonator length Ls is defined as a distance between the first selective conduction path (119) and the open end (111*b*) of the slot region (109) located at the leading end in an −X direction. A slot width Ws is defined as a distance between the first ground conductor (101*a*) and the second ground conductor (101*b*).

When Ws is equal to or less than (Ls/8), Ls is prescribed equal to a ¼ effective wavelength at a center frequency f0 of an operating band.

When Ws exceeds (Ls/8), (2Ls+Ws) is prescribed equal to a ½ effective wavelength at the center frequency f0 of the operating band.

In a first state, the first selective conduction path (119) is selected to be in a conducting state and the second selective conduction path (121) is selected to be in an open state, thus causing a main beam to be emitted (123*a*) in the −X direction. In a second state, the first selective conduction path (119) is selected to be in an open state and the second selective conduction path (121) is selected to be in a conducting state, thus causing a main beam to be emitted (123*b*) in the X direction.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. A variable directivity slot antenna comprising:

a dielectric substrate; and a ground conductor and a slot region formed on a rear face of the dielectric substrate, the ground conductor having a finite area, wherein, the slot region divides the ground conductor into a first ground conductor and a second ground conductor;

both leading ends of the slot region are open ends;

at least two selective conduction paths are further provided on the rear face of the dielectric substrate, the at least two selective conduction paths traversing the slot region to connect the first ground conductor and the second ground conductor;

a feed line intersecting the slot region at a feeding site near a center of the slot region along a longitudinal direction thereof is provided on a front face of the dielectric substrate;

the at least two selective conduction paths include a first selective conduction path and a second selective conduction path;

a slot resonator length Ls is defined as a distance between the first selective conduction path and the open end of the slot region located at the leading end in an −X direction;

a slot width Ws is defined as a distance between the first ground conductor and the second ground conductor;

a distance between the second selective conduction path and the open end of the slot region located at the leading end in an X direction is equal to the slot resonator length Ls;

when Ws is equal to or less than (Ls/8), Ls is prescribed equal to a ¼ effective wavelength at a center frequency f0 of an operating band;

when Ws exceeds (Ls/8), (2Ls+Ws) is prescribed equal to a ½ effective wavelength at the center frequency f0 of the operating band;

in a see-through plan view in which the variable directivity slot antenna is seen through from a normal direction of the dielectric substrate, the feed line appears interposed between the first selective conduction path and the second selective conduction path;

the X direction is defined as the longitudinal direction of the slot region, a Y direction is defined as a longitudinal direction of the feed line, and a Z direction is defined as the normal direction of the dielectric substrate;

the first selective conduction path is disposed between the open end of the slot region located at the leading end in the X direction and the feeding site, and the second selective conduction path is disposed between the open end of the slot region located at the leading end in the −X direction and the feeding site;

in a first state, the first selective conduction path is selected to be in a conducting state and the second selective conduction path is selected to be in an open state, thus causing a main beam to be emitted in the −X direction; and in a second state, the first selective conduction path is selected to be in an open state and the second selective conduction path is selected to be in a conducting state, thus causing a main beam to be emitted in the X direction.

2. The variable directivity slot antenna of claim 1, wherein the feed line and the slot region are shaped so as to be mirror symmetrical near the feeding site, and the X direction and the −X direction are mirror symmetrical directions.

3. The variable directivity slot antenna of claim 2, wherein the X direction and the −X direction are parallel and opposite.

4. The variable directivity slot antenna of claim 1, wherein, at a leading end, the feed line of a region spanning a length of a ¼ effective wavelength at the center frequency of the operating band from an open-end point is an inductive resonator region composed of a line having a characteristic impedance higher than 50Ω; and the feed line intersects the slot region at a central portion of the inductive resonator region.

5. The variable directivity slot antenna of claim 1, wherein, the first selective conduction path includes plural portions;

in the first state; at least one of the plural portions of the first selective conduction path is selected to be in a conducting state and the second selective conduction path is selected to be in an open state, thus causing a main beam to be emitted in the −X direction; and in the second state, all of the plural portions of the first selective conduction path are selected to be in an open state and the second selective conduction path is selected to be in a conducting state, thus causing a main beam to be emitted in the X direction.

6. The variable directivity slot antenna of claim 1, wherein, the second selective conduction path includes plural portions;

in the first state, the first selective conduction path is selected to be in a conducting state and all of the plural portions of the second selective conduction path are selected to be in an open state, thus causing a main beam to be emitted in the −X direction; and in the second state, the first selective conduction path is selected to be in an open state and at least one of the plural portions of the second selective conduction path is selected to be in a conducting state, thus causing a main beam to be emitted in the X direction.

7. The variable directivity slot antenna of claim 1, wherein the slot region includes a portion in which the slot width has a tapered increased toward each open end.

8. The variable directivity slot antenna of claim 1, wherein portions of outer perimeters of the first ground conductor and the second ground conductor that oppose each other via the slot region have a planar shape with a plurality of protrusions and depressions flanking along the X direction when viewed from the Z direction.

9. The variable directivity slot antenna of claim 1, wherein the feed line has a uniform line width.

10. The variable slot antenna of claim 1, wherein, a portion of the feed line spanning a length of a ¼ effective wavelength at the center frequency of the operating band from an open-end point has a narrower line width than a line width of any other portion; and the feed line intersects the slot region at a central portion of the portion of the feed line spanning a length of a ¼ effective wavelength at the center frequency of the operating band from said open-end point.

11. A driving method for a variable directivity slot antenna, the variable directivity slot antenna including:

a dielectric substrate; and a ground conductor and a slot region formed on a rear face of the dielectric substrate, the ground conductor having a finite area, wherein, the slot region divides the ground conductor into a first ground conductor and a second ground conductor;

both leading ends of the slot region are open ends;

at least two selective conduction paths are further provided on the rear face of the dielectric substrate, the at least two selective conduction paths traversing the slot region to connect the first ground conductor and the second ground conductor;

a feed line intersecting the slot region at a feeding site near a center of the slot region along a longitudinal direction thereof is provided on a front face of the dielectric substrate;

the at least two selective conduction paths include a first selective conduction path and a second selective conduction path;

a slot resonator length Ls is defined as a distance between the first selective conduction path and the open end of the slot region located at the leading end in an −X direction;

a slot width Ws is defined as a distance between the first ground conductor and the second ground conductor;

a distance between the second selective conduction path and the open end of the slot region located at the leading end in an X direction is equal to the slot resonator length Ls;

when Ws is equal to or less than (Ls/8), Ls is prescribed equal to a ¼ effective wavelength at a center frequency f0 of an operating band;

when Ws exceeds (LsI8), (2Ls+Ws) is prescribed equal to a ½ effective wavelength at the center frequency f0 of the operating band;

in a see-through plan view in which the variable directivity slot antenna is seen through from a normal direction of the dielectric substrate, the feed line appears interposed between the first selective conduction path and the second selective conduction path;

the X direction is defined as the longitudinal direction of the slot region, a Y direction is defined as a longitudinal direction of the feed line, and a Z direction is defined as the normal direction of the dielectric substrate;

the first selective conduction path is disposed between the open end of the slot region located at the leading end in the X direction and the feeding site, and the second selective conduction path is disposed between the open end of the slot region located at the leading end in the −X direction and the feeding site;

the method comprising:

a first step of selecting the first selective conduction path to be in a conducting state and selecting the second selective conduction path to be in an open state, thus causing a main beam to be emitted in the −X direction; and a second step of selecting the first selective conduction path to be in an open state and selecting the second selective conduction path to be in a conducting state, thus causing a main beam to be emitted in the X direction.

12. The driving method for a variable directivity slot antenna of claim 11, wherein the feed line and the slot region are shaped so as to be mirror symmetrical near the feeding site, and the X direction and the −X direction are mirror symmetrical directions.

13. The driving method for a variable directivity slot antenna of claim 12, wherein the X direction and the −X direction are parallel and opposite.

14. The driving method for a variable directivity slot antenna of claim 11, wherein, at a leading end, the feed line of a region spanning a length of a ¼ effective wavelength at the center frequency of the operating band from an open-end point is an inductive resonator region composed of a line having a characteristic impedance higher than 50Ω; and the feed line intersects the slot region at a central portion of the inductive resonator region.

15. The driving method for a variable directivity slot antenna of claim 11, wherein, the first selective conduction path includes plural portions;

in the first step, at least one of the plural portions of the first selective conduction path is selected to be in a conducting state and the second selective conduction path is selected to be in an open state, thus causing a main beam to be emitted in the −X direction; and in the second step, all of the plural portions of the first selective conduction path are selected to be in an open state and the second selective conduction path is selected to be in a conducting state, thus causing a main beam to be emitted in the X direction.

16. The driving method for a variable directivity slot antenna of claim 11, wherein, the second selective conduction path includes plural portions;

in the first step, the first selective conduction path is selected to be in a conducting state and all of the plural portions of the second selective conduction path are selected to be in an open state, thus causing a main beam to be emitted in the −X direction; and in the second step, the first selective conduction path is selected to be in an open state and at least one of the plural portions of the second selective conduction path is selected to be in a conducting state, thus causing a main beam to be emitted in the X direction.

17. The driving method for a variable directivity slot antenna of claim 11, wherein the slot region includes a portion in which the slot width has a tapered increased toward each open end.

18. The driving method for a variable directivity slot antenna of claim 11, wherein portions of outer perimeters of the first ground conductor and the second ground conductor that oppose each other via the slot region have a planar shape with a plurality of protrusions and depressions flanking along the X direction when viewed from the Z direction.

19. The driving method for a variable directivity slot antenna of claim 11, wherein the feed line has a uniform line width.

20. The driving method for a variable directivity slot antenna of claim 11, wherein, a portion of the feed line spanning a length of a ¼ effective wavelength at the center frequency of the operating band from an open-end point has a narrower line width than a line width of any other portion; and the feed line intersects the slot region at a central portion of the portion of the feed line spanning a length of a ¼ effective wavelength at the center frequency of the operating band from said open-end point.

* * * * *

UNITED STATES PATENT AND TRADEMARK OFFICE

CERTIFICATE OF CORRECTION

PATENT NO. : 7,538,736 B2
APPLICATION NO. : 12/179059
DATED : May 26, 2009
INVENTOR(S) : Hiroshi Kanno et al.

It is certified that error appears in the above-identified patent and that said Letters Patent is hereby corrected as shown below:

In Column 18, Line 14 (Claim 11), change "(LsI8)" to --(Ls/8)--.

Signed and Sealed this

Twenty-ninth Day of September, 2009

David J. Kappos

David J. Kappos
*Director of the United States Patent and Trademark Office*